US008919689B2

(12) United States Patent
Kuchar et al.

(10) Patent No.: US 8,919,689 B2
(45) **Date of Patent: *Dec. 30, 2014**

(54) APPARATUS TO DEPLOY AND EXPAND WEB MATERIAL

(75) Inventors: Matthew J. Kuchar, Metuchen, NJ (US); David M. Kuchar, Metuchen, NJ (US)

(73) Assignee: KUCHARCO Corporation, Metuchen, NJ (US)

( * ) Notice: Subject to any disclaimer, the term of this patent is extended or adjusted under 35 U.S.C. 154(b) by 17 days.

This patent is subject to a terminal disclaimer.

(21) Appl. No.: 13/112,106

(22) Filed: May 20, 2011

(65) Prior Publication Data

US 2013/0240657 A1 Sep. 19, 2013

Related U.S. Application Data

(63) Continuation-in-part of application No. 12/943,822, filed on Nov. 10, 2010.

(60) Provisional application No. 61/260,807, filed on Nov. 12, 2009.

(51) Int. Cl.

| | |
|---|---|
| ***B65H 75/18*** | (2006.01) |
| ***B65H 23/022*** | (2006.01) |
| ***B65H 16/00*** | (2006.01) |

(52) U.S. Cl.

CPC ..... *B65H 23/022* (2013.01); *B65H 16/005* (2013.01); *B65H 2301/41369* (2013.01)

USPC ..... 242/597.8; 242/580.1

(58) Field of Classification Search

USPC ..... 242/597, 597.7, 597.8, 580, 580.1, 579, 242/585

See application file for complete search history.

(56) References Cited

U.S. PATENT DOCUMENTS

| | | | | |
|---|---|---|---|---|
| 347,324 | A | 8/1886 | Cramer | 229/120.4 |
| 1,895,642 | A | 1/1933 | Preble | 55/487 |
| 2,037,164 | A | 4/1936 | Harrah | 55/489 |
| 2,319,225 | A | 5/1943 | Grebe et al. | 52/670 |
| 2,493,726 | A | 1/1950 | O'Day | 55/443 |
| 2,558,185 | A | 6/1951 | Leisen | 55/520 |
| 2,602,521 | A | 7/1952 | Smith | 55/487 |
| 2,989,145 | A | 6/1961 | Goodloe | 55/443 |
| 3,040,968 | A | 6/1962 | Long et al. | 229/87.08 |
| 3,067,039 | A | 12/1962 | Crane | 426/106 |
| 3,069,067 | A | 12/1962 | Crane | 229/87.08 |

(Continued)

*Primary Examiner* — William A Rivera

(74) *Attorney, Agent, or Firm* — Ernest D. Buff & Associates, LLC; Ernest D. Buff, Esq.

(57) ABSTRACT

A dispenser to deploy and expand cut web material uniformly to form a three dimensional lattice. The unexpanded web material is substantially longer than it is wide. The web material is die cut and has essentially parallel longitudinal strands on opposite transverse sides. The dispenser tracks the threaded web material over three rollers, and uses an adjustable braking mechanism that creates diagonal web tension to pull the paper from the roll. After the web material is threaded through the mechanism, simply pulling the web material on the opposite side from the rollers deploys and expands it simultaneously. The unit can accommodate a plurality of rolls of web material mounted to deploy and expand either individually or simultaneously. The web material itself may have more than one layer. An exemplary embodiment of the dispenser is a motorized version, where a motorized guide wheel assembly pulls the web material, thereby eliminating the necessity of manual deployment.

28 Claims, 35 Drawing Sheets

(56) References Cited

U.S. PATENT DOCUMENTS

| | | | | |
|---|---|---|---|---|
| 3,080,579 | A | 3/1963 | Gordon | 267/103 |
| 3,109,579 | A | 11/1963 | Crane | 229/87.08 |
| 3,245,606 | A | 4/1966 | Crane | 383/103 |
| 3,346,246 | A | 10/1967 | Loetel et al. | 261/103 |
| 3,407,550 | A | 10/1968 | Shaw | 52/101 |
| 3,550,842 | A | 12/1970 | Scholz | 229/87.08 |
| 3,603,369 | A | 9/1971 | Scholz | 229/87.08 |
| 3,655,501 | A | 4/1972 | Tesch | 428/136 |
| 3,744,222 | A | 7/1973 | Delao | 55/446 |
| 3,762,629 | A | 10/1973 | Bruno | 229/87.08 |
| 3,825,465 | A | 7/1974 | Stock | 428/135 |
| 3,839,525 | A | 10/1974 | Doll | 264/154 |
| 3,958,751 | A | 5/1976 | Bruno | 229/87.08 |
| 3,966,044 | A | 6/1976 | Cunningham | 206/427 |
| 4,136,771 | A | 1/1979 | Owen | 206/150 |
| 4,170,691 | A | 10/1979 | Rogers | 428/572 |
| 4,306,675 | A | 12/1981 | Swanson | 229/120.07 |
| 4,501,707 | A | 2/1985 | Buhlmann | 261/94 |
| 4,997,721 | A | 3/1991 | Shaw et al. | 428/557 |
| 5,244,715 | A | 9/1993 | Kuchar | 428/195.1 |
| 5,252,111 | A | 10/1993 | Spencer | 55/489 |
| 5,500,271 | A | 3/1996 | Pasch et al. | 428/135 |
| 5,575,435 | A * | 11/1996 | Sperry et al. | 242/421.4 |
| 5,691,032 | A | 11/1997 | Trueblood et al. | 428/136 |

* cited by examiner

APPARATUS TO DEPLOY AND EXPAND WEB MATERIAL

CROSS REFERENCE TO RELATED APPLICATIONS

This Present application is a continuation-in-part (CIP) of my currently pending U.S. patent application Ser. No. 12/943,822 filed on Nov. 10, 2010 entitled "APPARATUS TO DEPLOY AND EXPAND WEB MATERIAL" (hereinafter, the Parent application), which is in turn the non-provisional counterpart of U.S. Provisional Patent Application Ser. No. 61/260,807 filed on Nov. 12, 2009. The Present application claims the benefit of and priority to said Provisional patent application and the Parent application which are both incorporated herein by reference in their entirety. The Present application is also related to my U.S. Pat. No. 6,929,843, issued on Aug. 16, 2005, entitled Fence Tape, which is also incorporated by reference herein in its entirety. Said US patent is hereinafter referred to as the Fence Tape Patent. It is also related to my currently pending U.S. patent application Ser. No. 12/755,316 filed on Apr. 6, 2010 entitled "EXPANDABLE WEB MATERIAL" (hereinafter, the Expandable Web Application), which is also incorporated by reference herein in its entirety. The Expandable Web Application was published on Aug. 5, 2010 as Pub. No. US 2010/0196633 A1.

BACKGROUND OF THE INVENTION

The Fence Tape patent discloses a web material that deploys in the longitudinal direction, and when a force is applied, the material expands primarily in the width direction, but also has some expansion in the longitudinal direction. The Fence Tape patent recites a web material that, when expanded, comprises linear top and bottom strands and a plurality of cross members. The web material in its unexpanded state is cut in slits longitudinally in a specific pattern to enable this type of expansion.

The Expandable Web Application discloses two types of expandable web material having somewhat simpler and different slit cuts to enable a similar expansion to fence tape. One embodiment of the invention described therein comprises longitudinal strands, and another embodiment eliminates the longitudinal strands. FIG. 1 shows a portion of the unexpanded web material of the Expandable Web Application with a longitudinal strand on the bottom. FIG. 2 shows a portion of the web material after deployment and expansion. The Expandable Web Application deals primarily with a web material manufactured from paper, while the Fence Tape Patent deals primarily with a web material manufactured from a resinous or plastic material. However, these materials are interchangeable in both references. The advantage of using paper is for packaging material for shock absorption by folding several layers one on top of the other. FIG. 3 is an elevation view of the expanded material. It has a three-dimensional structure. When several layers lay upon one another, nooks and crannies interlock to form a spring-like structure capable of absorbing impact while creating substantial support. This material is as efficient as bubble wrap. However, the paper material can be supplied in an unexpanded state on a roll, and it occupies far less space than pre-expanded bubble wrap.

The Parent application discloses a device for deploying and expanding the unexpanded rolled material. That device is primarily intended for manual deployment of the web material having longitudinal strands. It may also be motorized. FIG. 4 shows manual expansion of the web material using the dispenser of the Parent application. That dispenser (hereinafter, the Original Dispenser) operates by passing the unexpanded web material between a pinch roller and toroidal guide roller. Pressure is applied to one side of the web material to hold it in place while a person pulls the opposite side of the web as shown. This device is large and bulky, and expansion is not as uniform as could be desired. It would be desirable to have a smaller device that tracks and expands the web material more uniformly, and would be easier to operate either in manual mode or with an electric motor and pinch rollers.

SUMMARY OF THE INVENTION

The Present Invention is an improved dispenser that is more compact, less expensive, and easier to use than the Original Dispenser. As with the Original Dispenser, the web material also has longitudinal strands on opposite sides. The device of the Present Invention tracks the threaded web material over three rollers instead of two and over a shorter distance than the Original Dispenser. The Present Invention uses an improved braking mechanism that creates web tension to pull the paper from the roll more effectively. After the web material is threaded through the mechanism, simply pulling the web material on the opposite side from the rollers deploys and expands it simultaneously. The unit can accommodate a plurality of rolls of web material mounted to deploy and expand either individually or simultaneously. The web material itself may have more than one layer. It is easier to create a motorized version for the dispenser of the Present Invention than for the Original Dispenser.

DESCRIPTION OF THE PREFERRED AND ALTERNATE EMBODIMENTS

Figure 1:
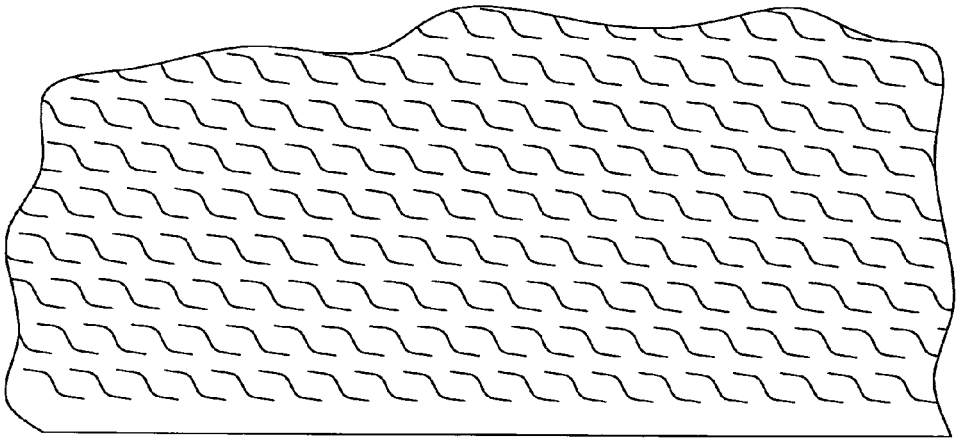
FIG. 1 is a plan view of a sheet of unexpanded web material.

The web material to be expanded is shown in FIG. 1. The unexpanded web material is considerably longer than it is wide, and there is at least one uncut longitudinal strand that runs the entire length of the spooled webbing. The longitudinal strand is shown in FIG. 1 at the bottom of the unexpanded web material. The longitudinal strand is grabbed by the guide wheels of the Present Invention, and is used to maintain the position of the web material in the transverse direction as it is being deployed. As will be shown later, the Present Invention works better if there is a second longitudinal strand parallel to the first longitudinal strand at the opposite transverse end of the unexpanded web material.

Figure 2:
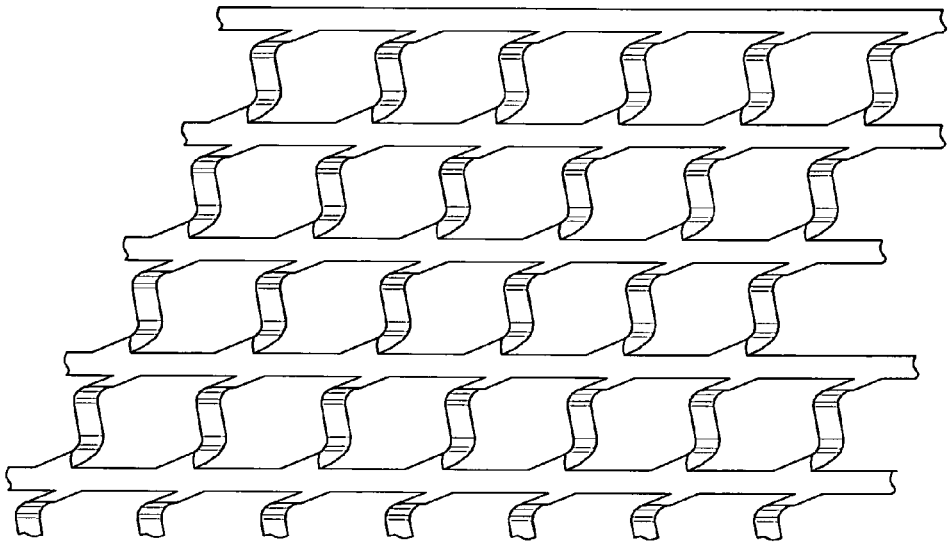
FIG. 2 is a plan view of a sheet of fully expanded web material.
Figure 3:
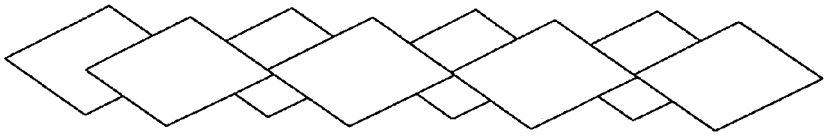
FIG. 3 is an elevation of fully expanded web material.
Figure 4:
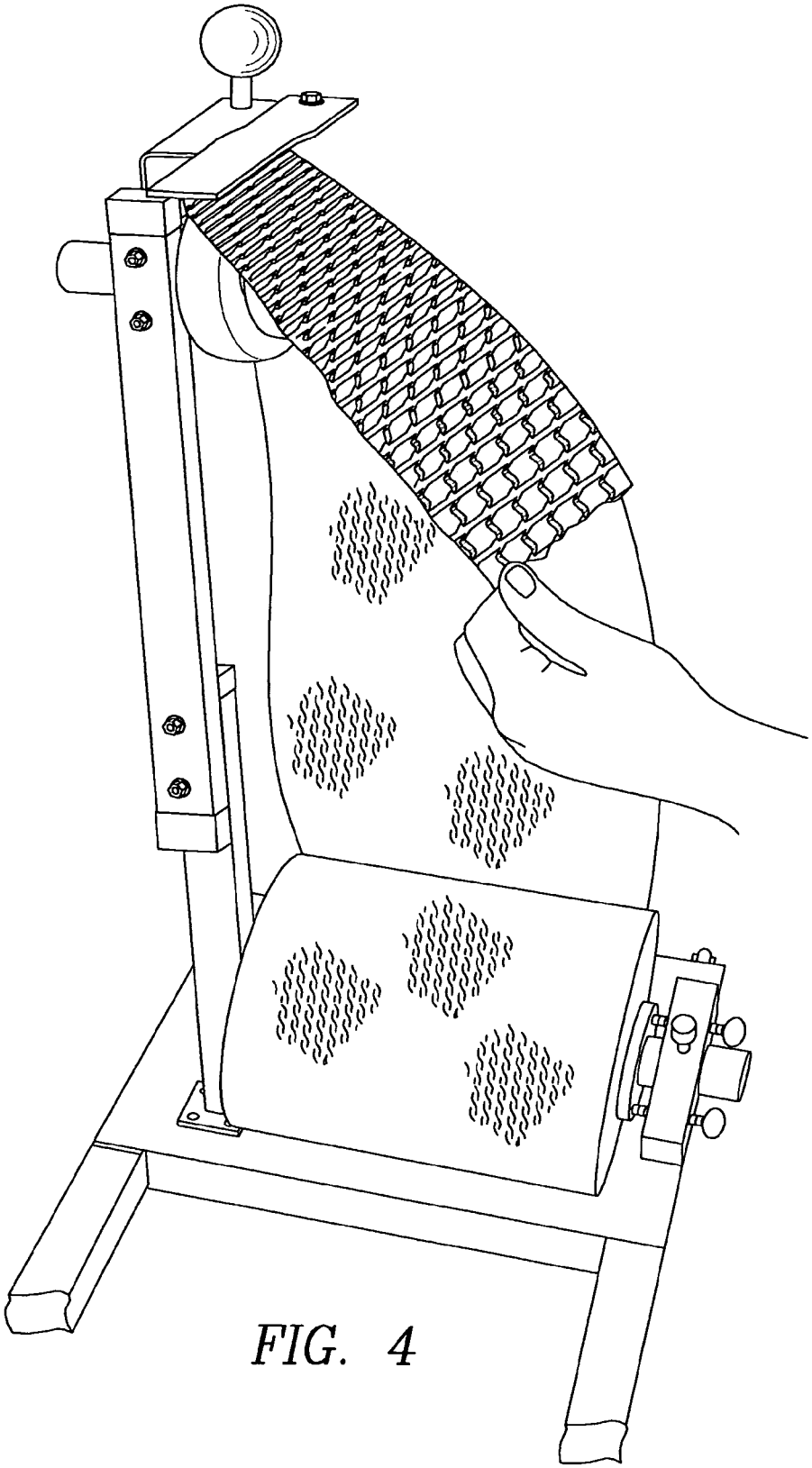
FIG. 4 shows web material being manually expanded and displaced during deployment using the dispenser of Parent U.S. patent application Ser. No. 12/943,822.
Figure 5:
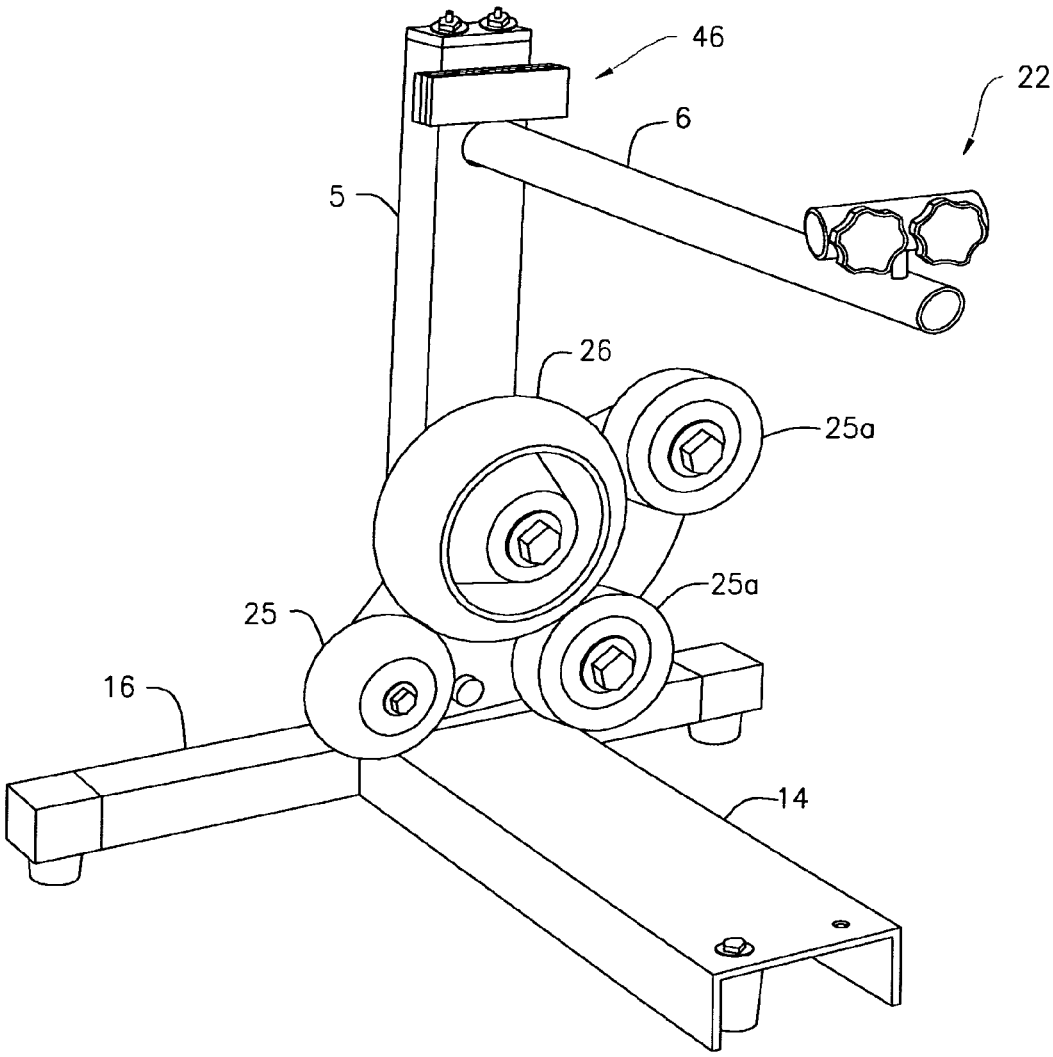
FIG. 5 is an isometric view of one embodiment (a single axle version) of the web material dispenser, which constitutes the Present Invention.
Figure 14:
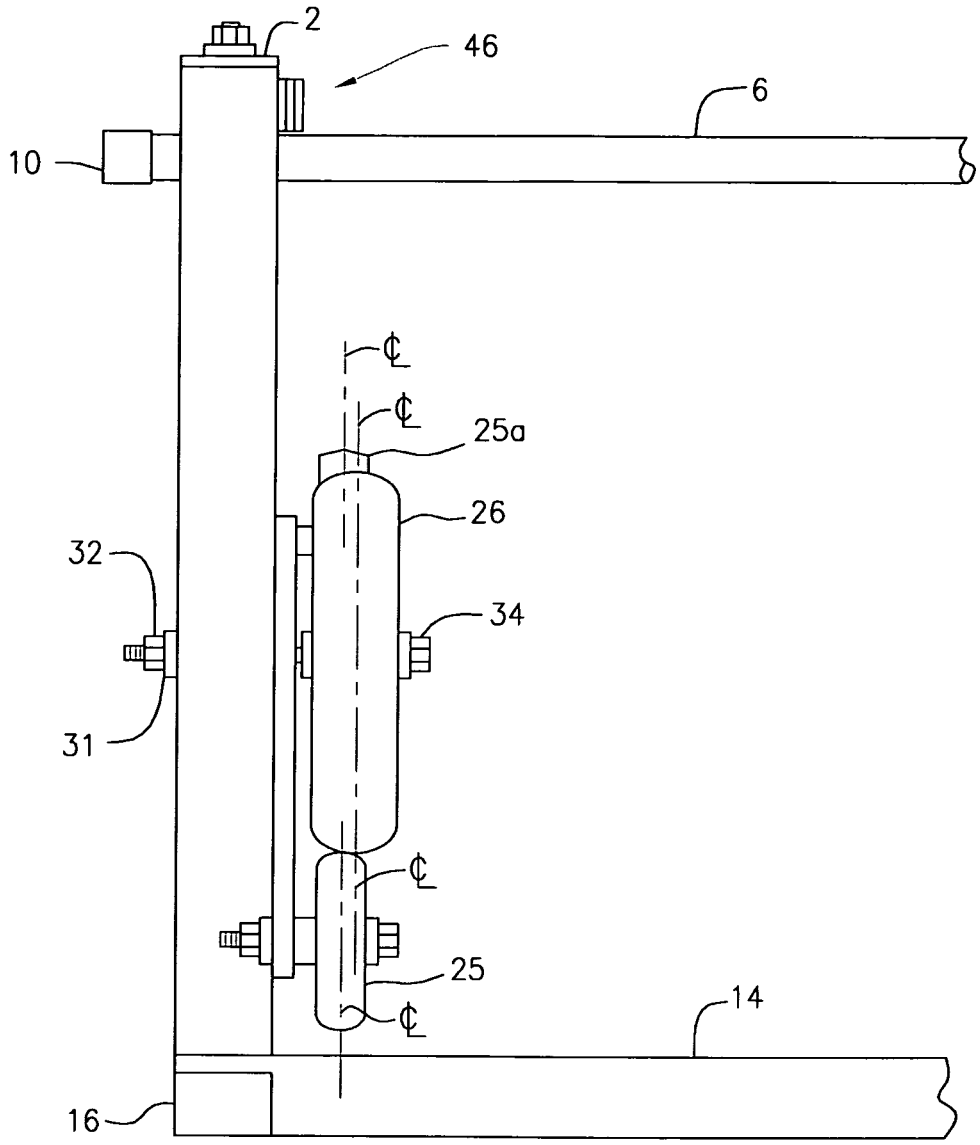
FIG. 14 is a front elevation of the entire apparatus of FIGS. 5 and 6.

The dispenser of the Present Invention comprises a heavily weighted base assembly, an axle, and a guide system to deploy and expand the web material. FIG. 5 is an isometric view of a first embodiment of the dispenser, which constitutes the Present Invention. This embodiment comprises a base 14, a stabilizing crossbar 16, and a main support tube 5 to which is fastened a single axle 6 that holds the spiral wound roll of web material (not shown) to be dispensed. The guide system further comprises guide wheels 25 and 25*a*. FIG. 14 is a front elevation of this first embodiment of the dispenser. The unexpanded web material is threaded through the guide system. The function of the guide system is to grab the unexpanded web material by the longitudinal strand and to maintain the transverse position of the web as it unrolls longitudinally through the guide wheels. Deployment and expansion is accomplished by pulling the unexpanded web material at a position diagonally transverse and ahead of the longitudinal position of the guide wheels. In this way, diagonal tension is applied to the web material that both pulls it through the guide system and expands it in both directions. The result is the expanded web material shown in FIG. 2.

Figure 6:
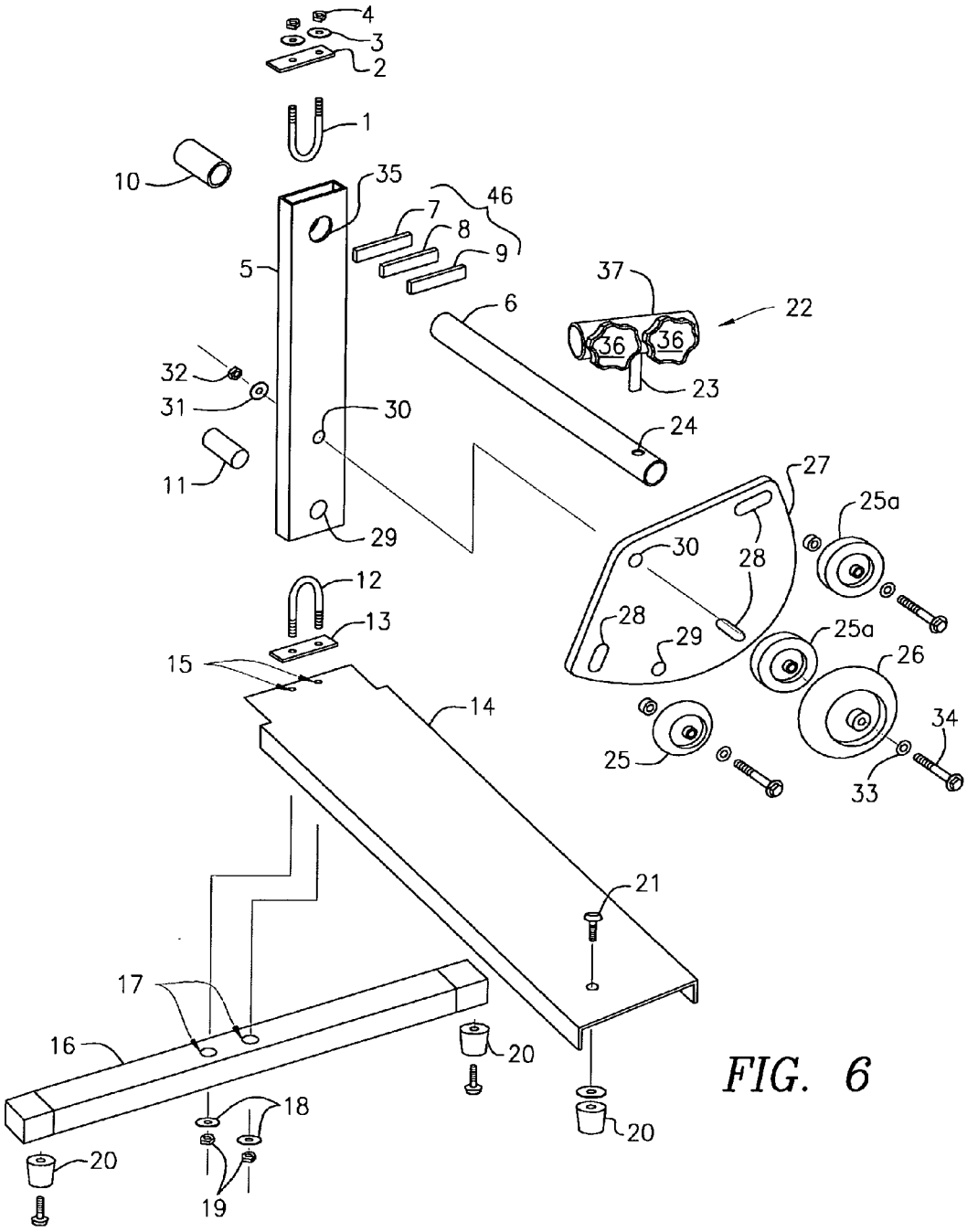
FIG. 6 is an exploded isometric view of the apparatus shown in FIG. 5.

FIG. 6 is an isometric exploded view of the first embodiment of the dispenser. The function of the top U-bolt 1 is to hold the axle 6 in place. Axle 6 is used to support a roll of unexpanded web material. Axle 6 is locked into position on the main support tube 5, which is secured to the base 14. It is held in place using pin 11 in conjunction with U-bolt 12, alignment plate 13 to stabilizing crossbar 16. It is fastened in place using washers 18 and locking nuts 19.

The U-bolt 1 is held in place on the top of the main support tube 5 using metal plate 2, washers 3, and nuts 4.

U-bolt 12 passes through alignment plate 13, through-holes 15 of base 14 and through-holes 17 of stabilizing crossbar 16.

Rubber feet 20 allow the unit to rest on a horizontal surface. There are three rubber feet, two of which are fastened to crossbar 16, and one that is fastened to base plate 14 using bolt 21.

Mounting plate 27 has three rectangular slots 28 having rounded corners for bolts to fasten guide wheels 25 and 25*a* comprising connector bushing assemblies that allow for through-holes and nuts to fasten them to plate 27. Guide wheels 25*a* are annular cylinders, while guide wheel 25 is a torus. Tracking wheel 26 is fastened to plate 27 using bolt 34 and washer 33, and is held in place using washer 31 and lock nut 32. Bolt 34 passes through holes 30. Guide wheels 25 and 25*a* pass through slots 28, and are firmly fastened using washers and lock nuts (not shown). The mounting plate 27 is aligned using aluminum cross-pin 11, which holds it in its proper location. Cross-pin 11 passes through holes 29.

Axle 6 holds the unexpanded web roll (not shown). Axle 6 passes through hole 35 in main support tube 5. Cap 10 covers the end of axle 6.

It is necessary to maintain constant tension on the unexpanded web material in order to obtain uniform web expansion. This is accomplished using a spring-loaded breaking mechanism comprising two component assemblies 46 and 22:

First Component:

The first component 46 comprises three rectangular plates: 7, 8, and 9.

Plate 7 is a steel backup plate.

Plate 8 is constructed from rubber (or other elastic material), and its elastic resilience increases as more pressure is applied.

Plate 9 is a plastic break pad or wear plate (i.e., the component part of the break in contact with the web core plug).

Second Component:

Break pressure adjuster assembly 22, comprising:

mounting pin 23, plastic cylinder 37, and two lobed knobs 36.

The break pressure adjuster assembly 22 mounts on axle 6 by passing mounting pin 23 of the assembly through hole 24 on the axle. Plastic cylinder 37 is the main structure holding components 36 and 23 together. Knobs 36 apply pressure on the core plug opposite to plastic break pad 9. Surface 38 of knob 36 makes contact with the core plug.

Figure 7:
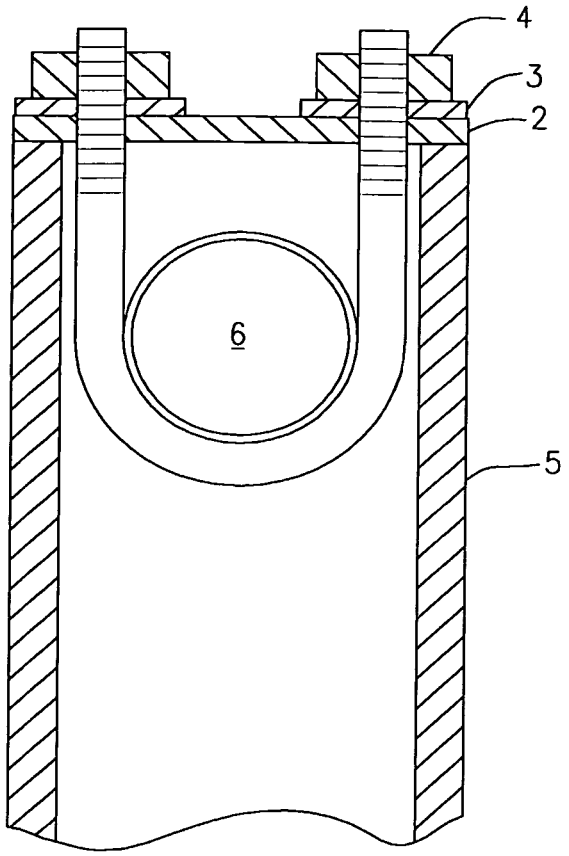
FIG. 7 is a cross-section showing the U-bolt mounting of the axle to the main support tube.

FIG. 7 is a detailed cross-section showing how U-Bolt 1 is used to mount axle 6 to main support tube 5 and to hold it firmly in place thereon. U-Bolt 1 has machine screw threads on both ends. Nuts 4 and washers 3 are screwed tightly onto both ends of the U-Bolt 1 to fasten it to metal plate 2, which rests firmly atop main support tube 5.

Figure 8:
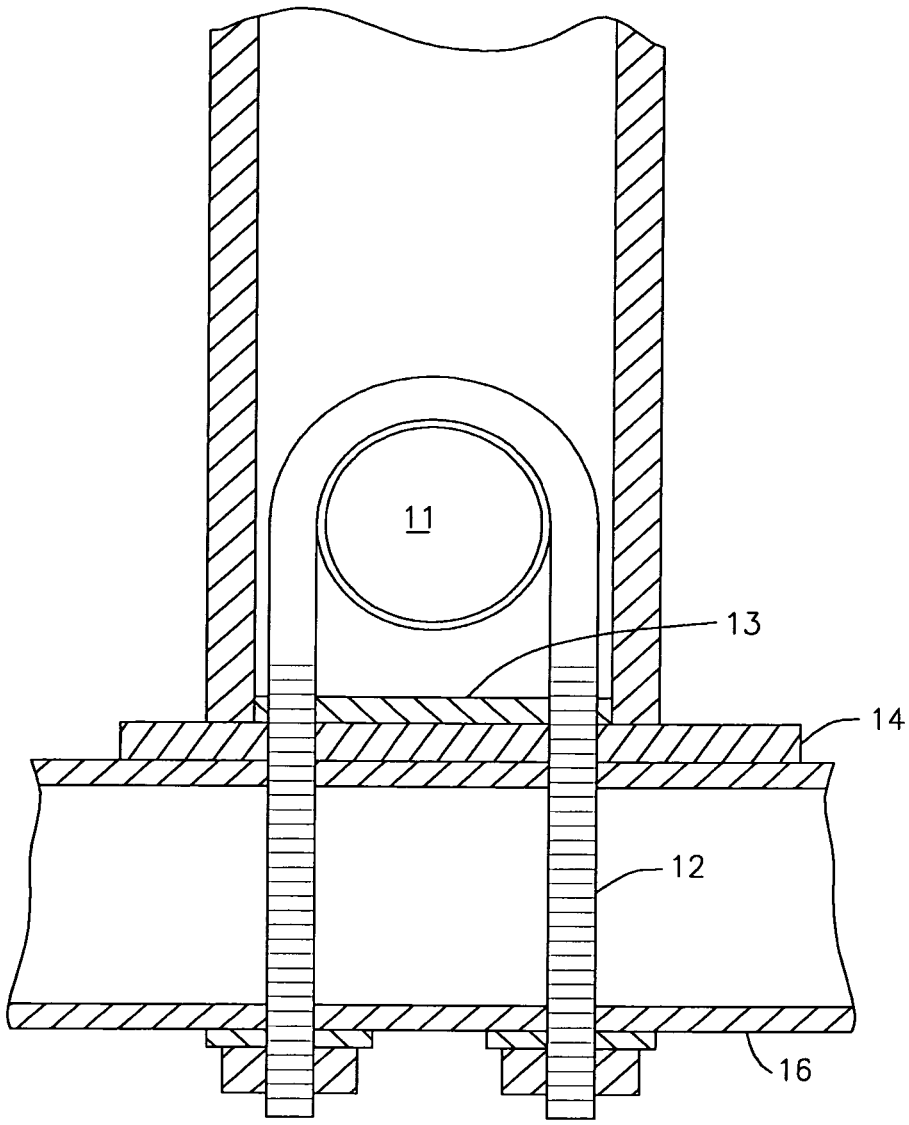
FIG. 8 is a cross-section showing the U-bolt mounting of the bottom of the main support tube.

FIG. 8 is a detailed cross-section showing how U-Bolt 12 is used to mount main support tube 5 to base 14. U-Bolt 12 is held in place by exerting pressure on aluminum cross pin 11. Alignment plate 13 rests firmly on base 14, which is fastened to stabilizing crossbar 16 using nuts 19 (shown in FIG. 6) and washers 18 (also shown in FIG. 6) screwed tightly onto both ends of U-Bolt 12. The screw threads of U-Bolt 12 face downward, and pass first through the holes in alignment plate 13, then through holes 15 (also shown in FIG. 6) in base 14, and finally through holes 17 (shown in FIG. 6).

Figure 9:
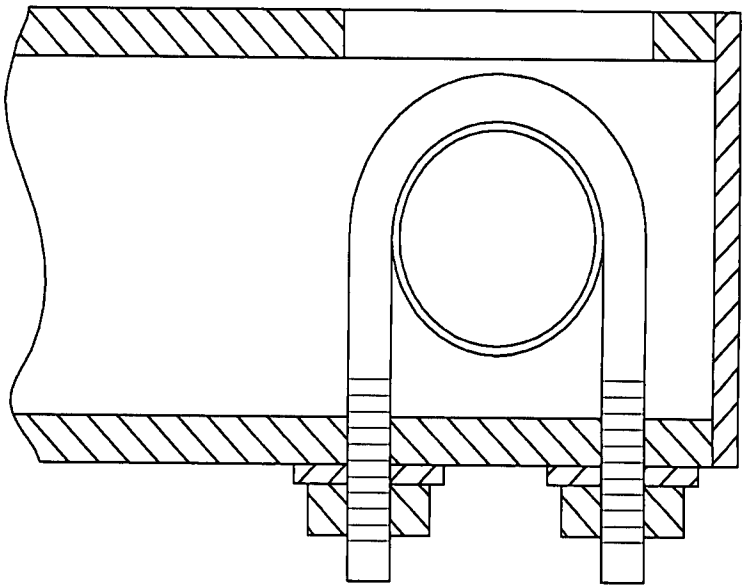
FIG. 9 is a cross-section showing a first alternate embodiment for U-bolt side mounting an axle to an intermediate location along the height of the main support tube.
Figure 10:
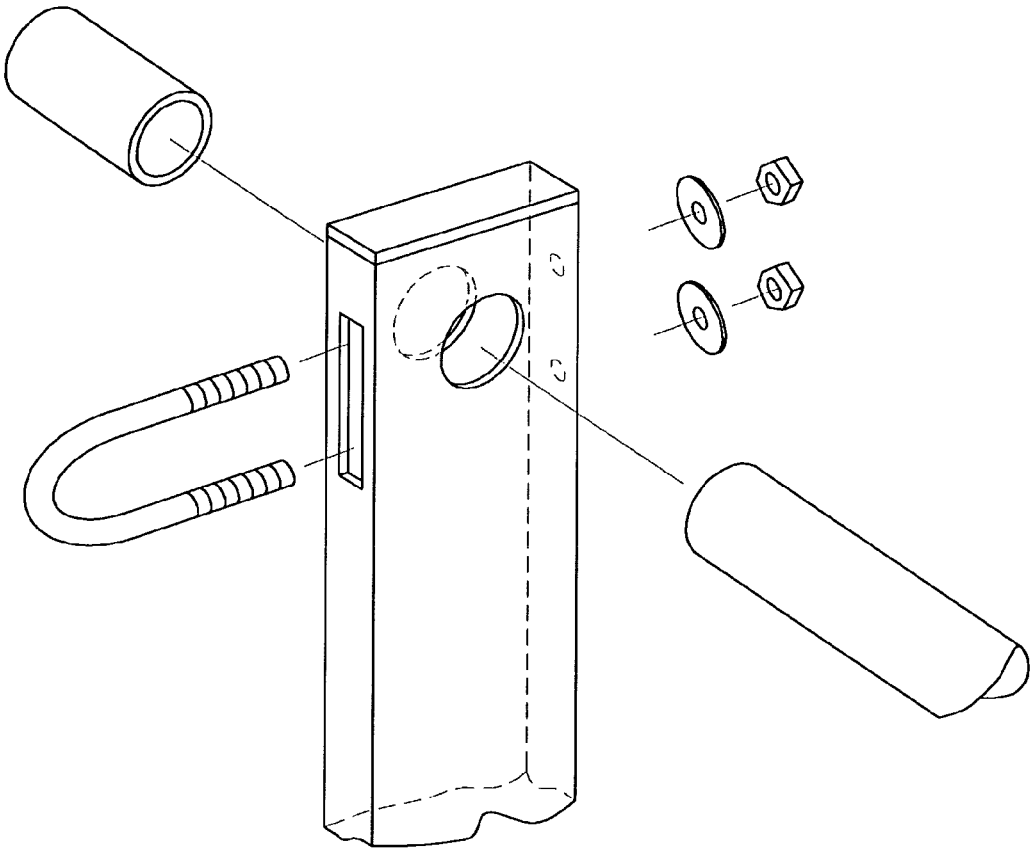
FIG. 10 is an isometric exploded view showing the first alternate embodiment for U-bolt side mounting shown in FIG. 9.

FIG. 9 is a cross-section showing a first alternate embodiment for U-Bolt side mounting an axle to an intermediate location along the height of main support tube 5. FIG. 10 is an isometric exploded view showing this first alternate mounting embodiment. Here, the axle is fed through a hole drilled in any position on the main support tube. In FIG. 10, the hole is drilled at the top of the main support tube, but it may be placed at any position. Once the axle is fed through the hole, a cap is placed over the end of the axle. The U-Bolt is fed through a slot drilled into the main support tube in a direction perpendicular to the hole through which the axle is placed. The U-Bolt holds the axle firmly in place once it is screwed tightly to the main support tube using nuts and washers as shown.

Figure 11:
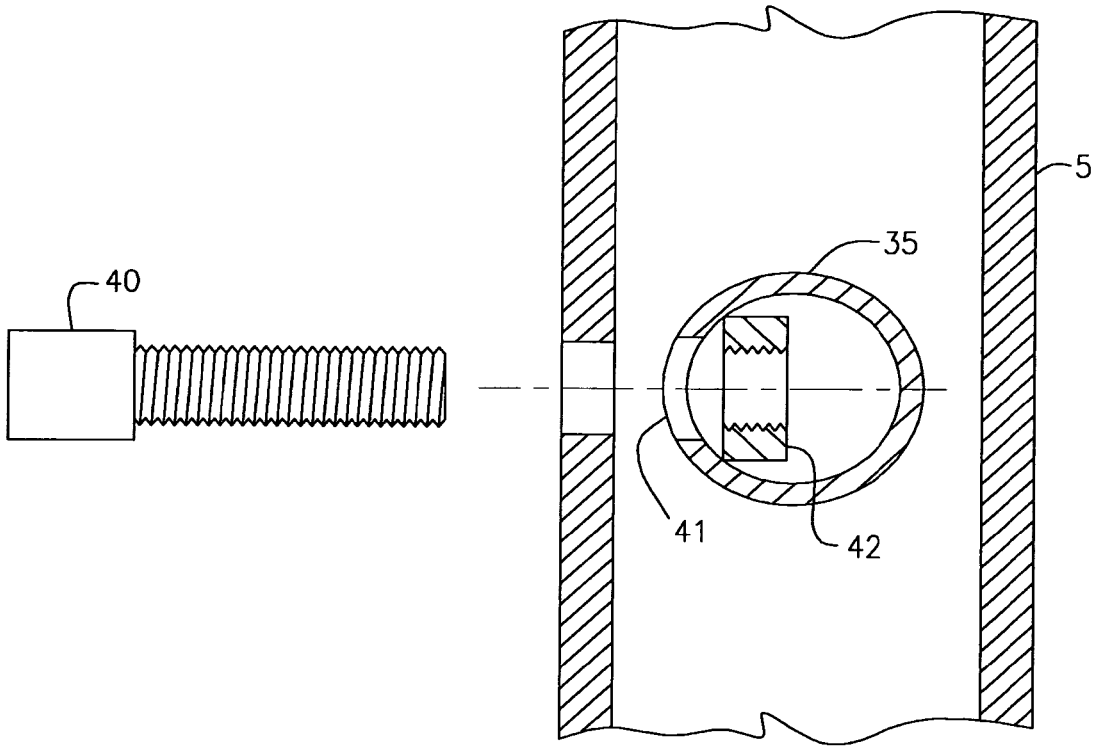
FIG. 11 is a cross-section showing a second alternate embodiment for side mounting an axle to an intermediate location along the height of the main support tube.
Figure 12:
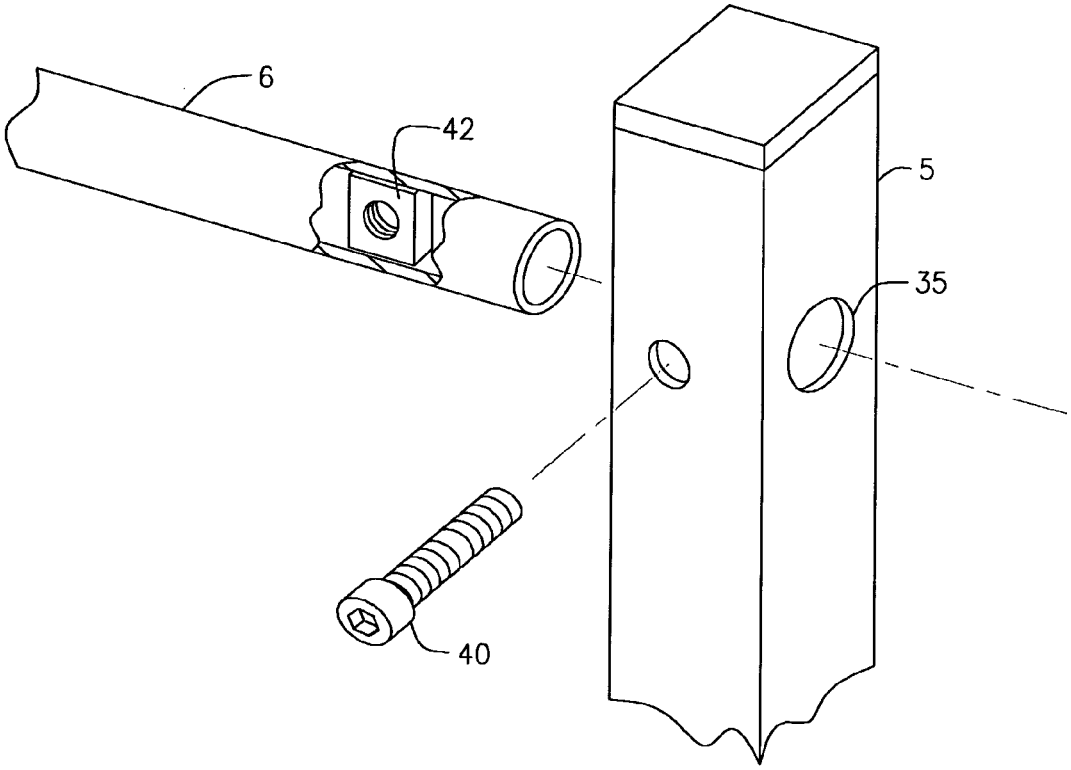
FIG. 12 is an isometric exploded view showing the second alternate embodiment for side mounting shown in FIG. 11.

FIG. 11 is a cross-section showing a second alternate embodiment for side mounting an axle to an intermediate location along the height of main support tube 5. FIG. 12 is an isometric exploded view showing this second alternate embodiment. Here, axle 6 is fed through hole 35 drilled at a desired height along main support tube 5. There is a hole 41 drilled into axle 6. A nut 42 is firmly attached to the inside of axle 6 such that the cylindrical center lines of nut 42 and hole 41 are coincident. When axle 6 is fed through hole 35, the axle is rotated around its cylindrical axis such that bolt 40 may be fed through the hole in main support tube 5, and into hole 41. Bolt 40 is then screwed into nut 42 to hold axle 6 in place.

Figure 13:
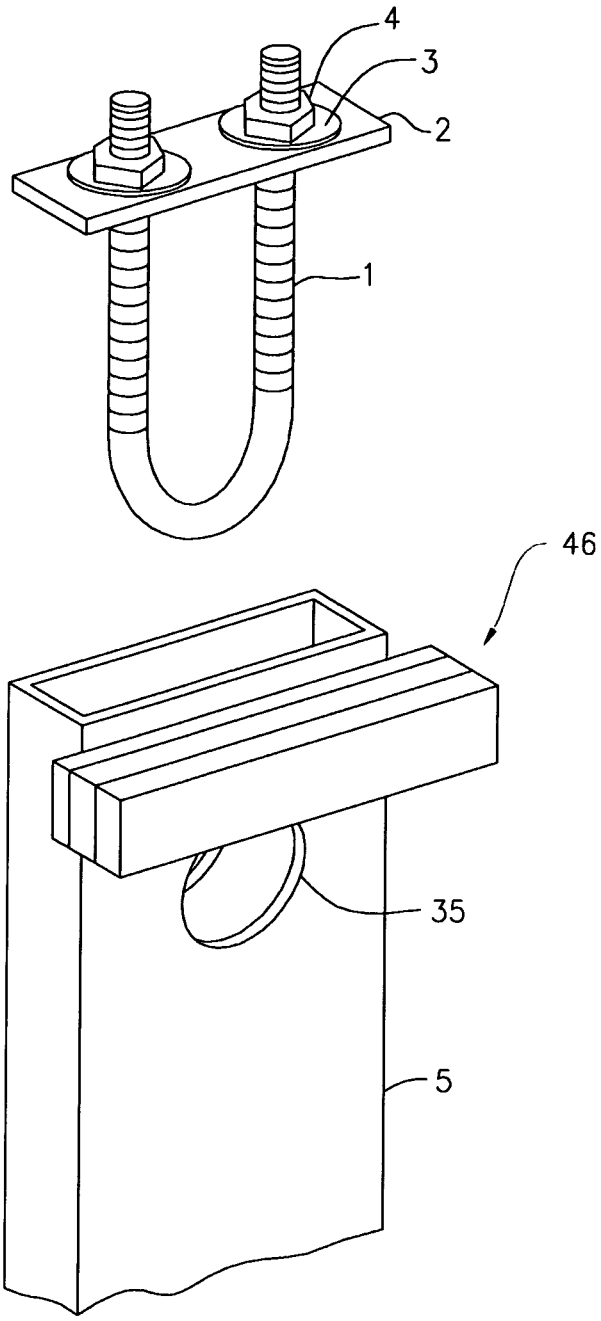
FIG. 13 is an isometric exploded view showing the top of the main support tube with the U-bolt and brake pad assembly. The axle is not shown.

Once again, considering the first embodiment of the U-Bolt top mounting of axle 6 in hole 35 of main support tube 5, FIG. 13 is an isometric exploded view showing the relative positioning of the brake pad assembly 46.

Figure 15:
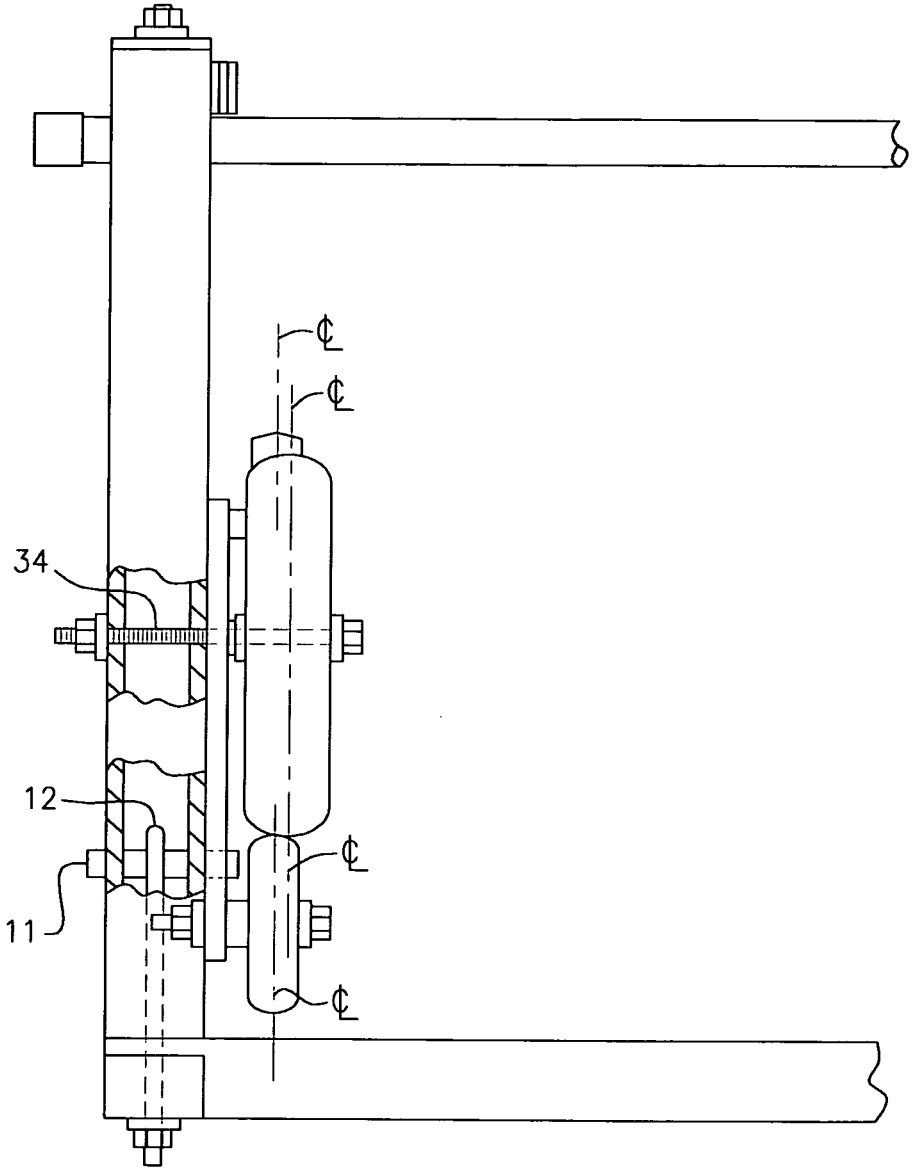
FIG. 15 is a cross-section of the apparatus of FIG. 14.

FIG. 14 is a front elevation of the first embodiment of the dispenser. From this drawing, it can be seen that the planes through which the toroidal shaped guide wheel 25 and through which the annular cylindrical guide wheels **25*a* pass are offset from one another. This is done to grab the web material to facilitate uniform expansion when the web material is pulled through. The fact that guide wheels 25 and 25*a* rotate in two different planes allows the longitudinal strand of the unexpanded web material to be grabbed at three different points. This provides for stable positioning of the unexpanded web material in the transverse direction as it is pulled longitudinally through the guide wheels. FIG. 15 is a cross-section of the apparatus in the same orientation as in FIG. 14. Here, the mounting of guide wheels 25 and 25*a*** is shown in more detail.

Figure 16:
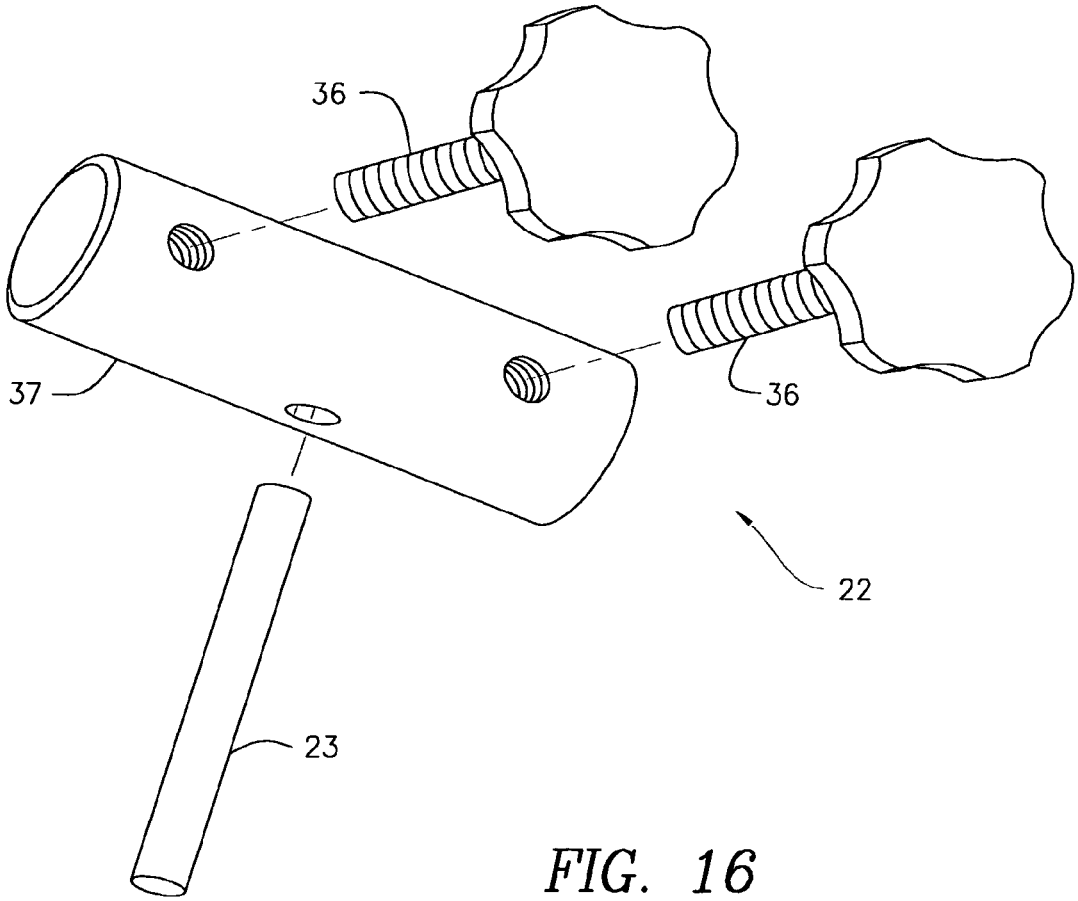
FIG. 16 is an exploded isometric view of the brake pressure adjuster as seen from the front of the adjuster assembly.
Figure 17:
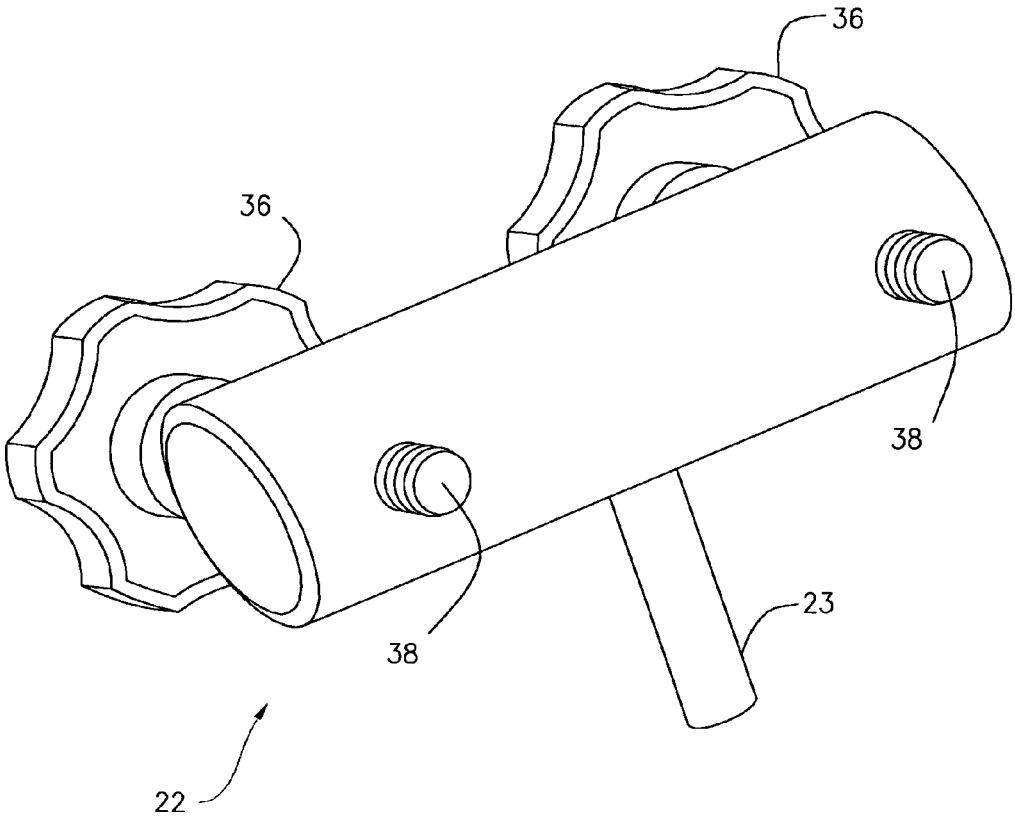
FIG. 17 is an isometric view of the fully assembled brake pressure adjuster as seen from the rear.

FIG. 16 and FIG. 17 show the details of brake pressure adjustment assembly 22. FIG. 16 is an exploded isometric view of the brake pressure adjuster as seen from the front of the adjuster assembly. FIG. 17 is an isometric view of the fully assembled brake pressure adjuster as seen from the rear. As shown in the drawings, the brake pressure adjustment assembly 22 comprises a plastic cylinder 37, through which a hole is drilled at the bottom and through which two machine screw threaded through-holes are made such that their axes lie in a direction perpendicular to the axis of the bottom hole. A mounting pin 23 is fitted through the bottom hole in cylinder 37. The other end of pin 23 is fitted into hole 24 in axle 6 (not shown). Lobed knobbed bolts 36 are screwed into the cylinder 37, and they extend through the other side of the cylinder. Surfaces 38 at the ends of bolts 36 contact the core plug's outer rim of core 39 of the spiral wound web material. As the bolts 36 are screwed such that surfaces 38 make firmer contact with the core plug, the resistance to deployment of the web material becomes greater.

Figure 18:
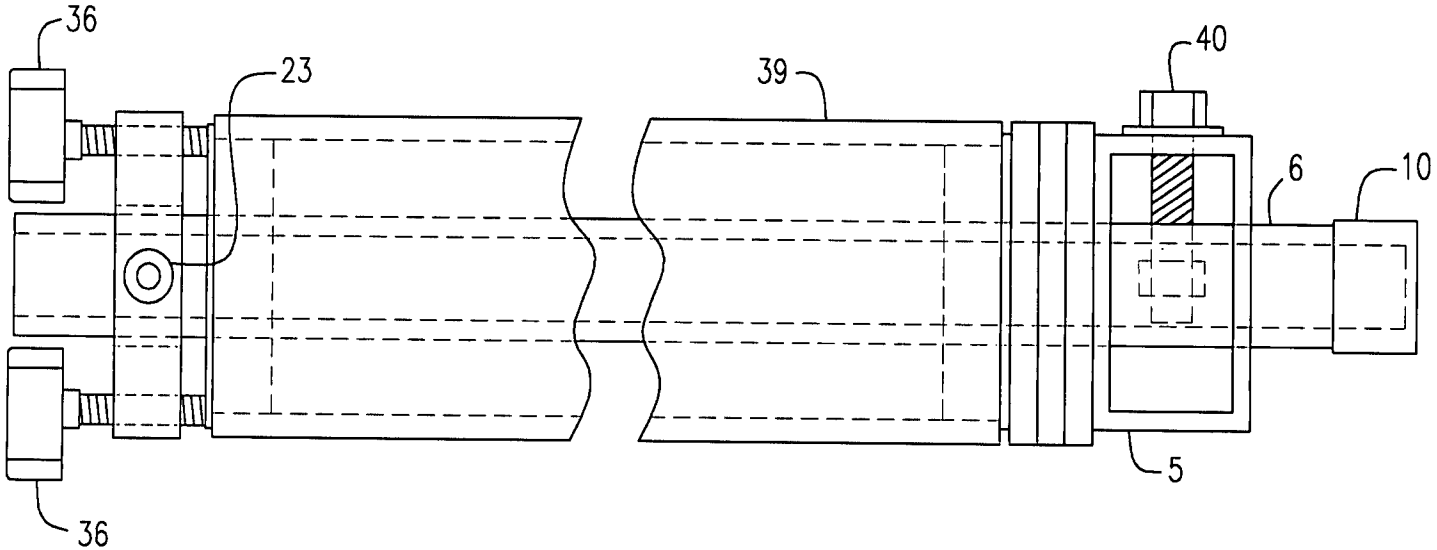
FIG. 18 is a top plan view of the axle assembly attached to main support tube. The cardboard core of spiral wound unexpanded web material is shown mounted on the axle. The web material itself is not shown.

FIG. 18 is a top plan view of the axle assembly 6 attached to the main support tube 5. The cardboard core 39 of the spiral wound unexpanded web material is shown mounted on axle 6. The web material itself is not shown. Here, the axle 6 is mounted to main support tube 5 by bolt 40 using the second alternate mounting embodiment discussed previously. The mounting pin 23 of brake pressure assembly 22 is shown in end view. As can be seen, the lobed knobbed bolts serve to apply braking pressure to rotation of core 39 around its cylindrical axis.

Figure 19:
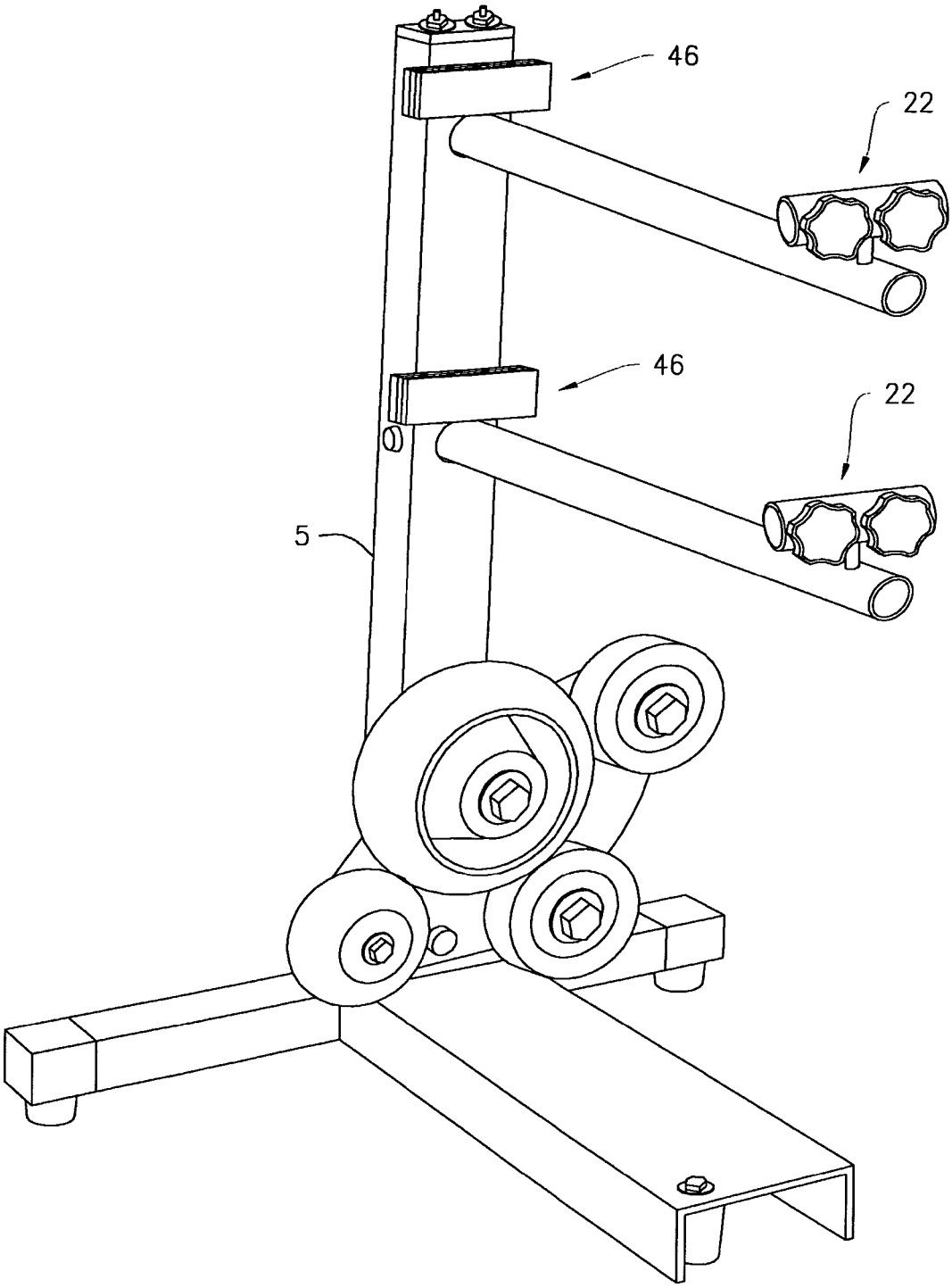
FIG. 19 is an isometric view of one embodiment (a double axle version) of the web material dispenser, which constitutes the Present Invention.

FIG. 19 is an isometric view of a second embodiment of the dispenser that constitutes the Present Invention. The second embodiment shown in the drawing is similar to that shown in FIG. 5, except that here there are two axles mounted on main support tube 5. Note that associated with each axle is a spring brake assembly 46 and a brake pressure adjustment assembly 22. The two axles shown can accept two rolls of unexpanded web material for deployment. It should be apparent to a person having ordinary skill in the art that the dispenser apparatus is not limited to one or two axles. It may have a plurality of axles. Three axles might be convenient, depending upon the size of the apparatus.

Figure 20:
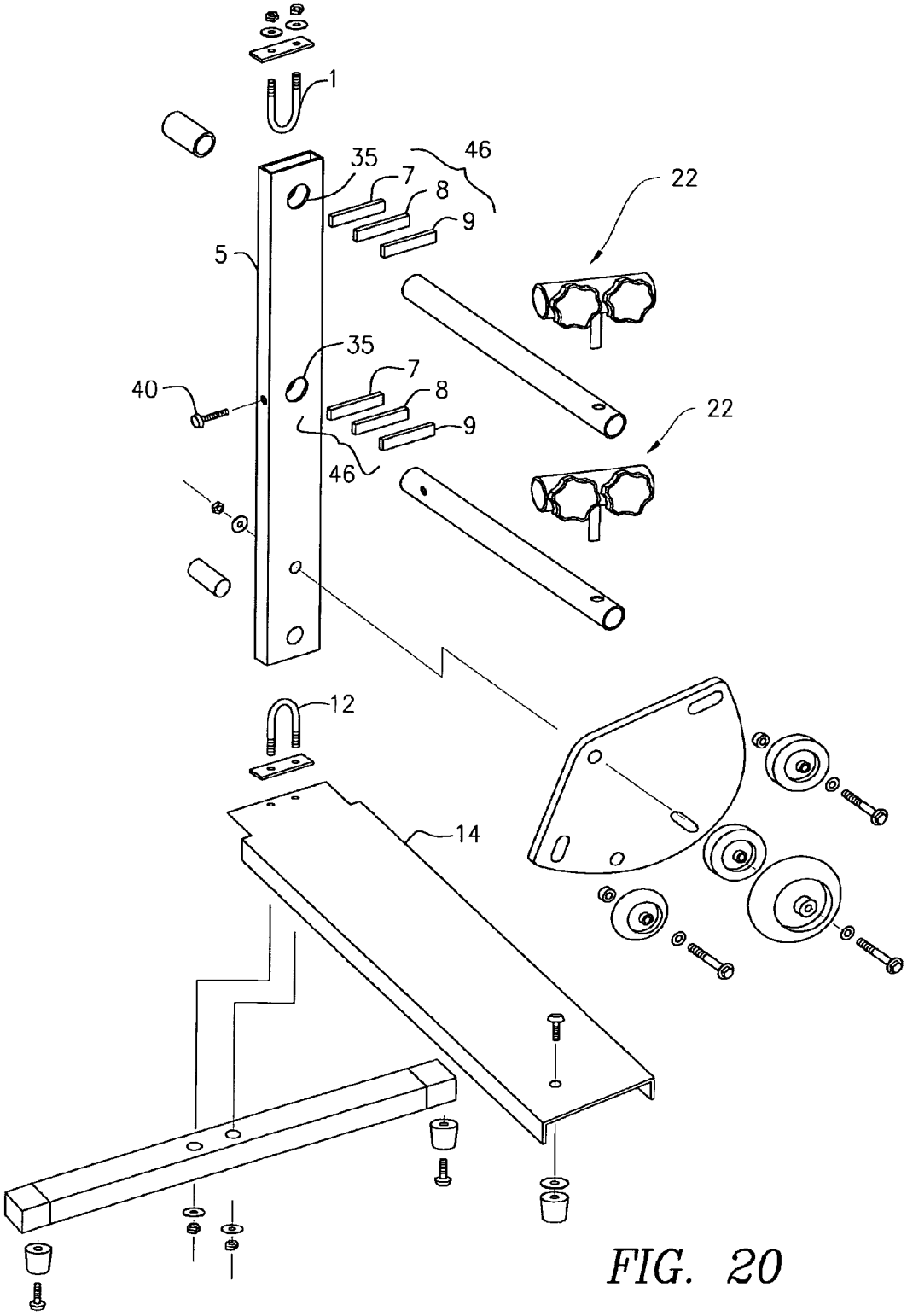
FIG. 20 is an exploded isometric view of the apparatus shown in FIG. 19.

FIG. 20 is an isometric exploded view of the second embodiment of the dispenser shown in FIG. 19. Here, the upper axle is mounted to the top of the main support tube 5 using the U-Bolt first mounting embodiment, while the lower axle is mounted to an intermediate height position on tube 5 using bolt 40 with the second alternate side-mounting embodiment.

Figure 21:
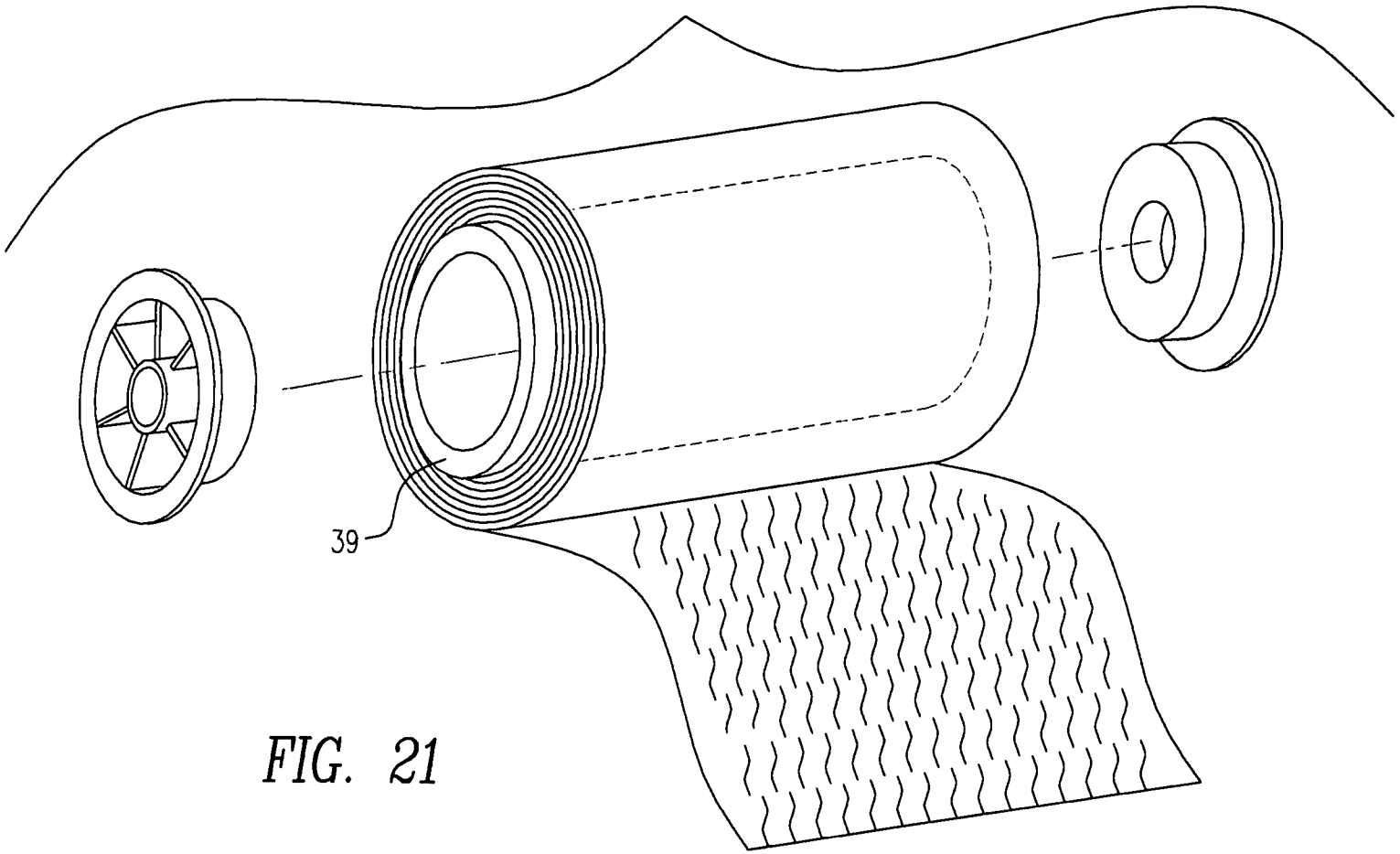
FIG. 21 is an isometric view of a roll of web material.

FIG. 21 shows the unexpanded web material wound around cardboard core 39. Two core plugs fit into both ends of the core. The axle passes through the center of both core plugs to facilitate mounting the web material.

Figure 22:
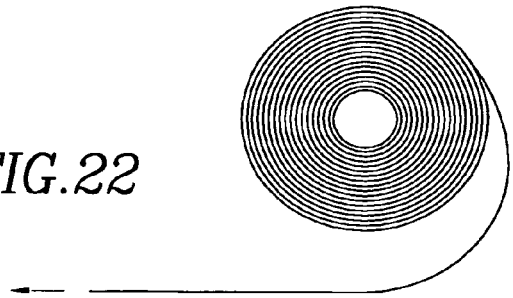
FIG. 22 is a schematic of a single roll of web material during dispensation from a single axle dispenser.
Figure 23:
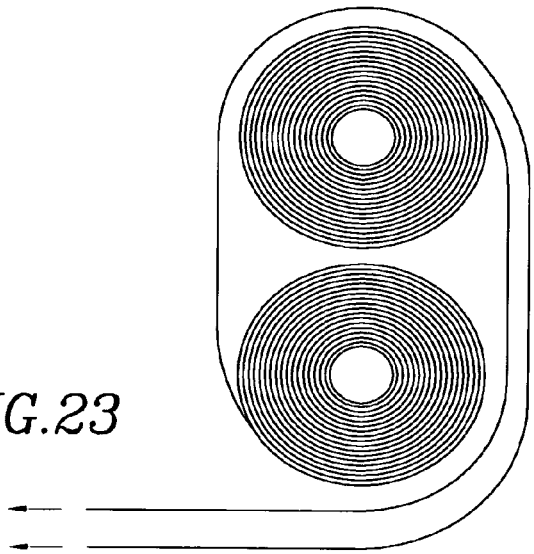
FIG. 23 is a schematic of two rolls of web material during dispensation from a double axle dispenser.
Figure 24:
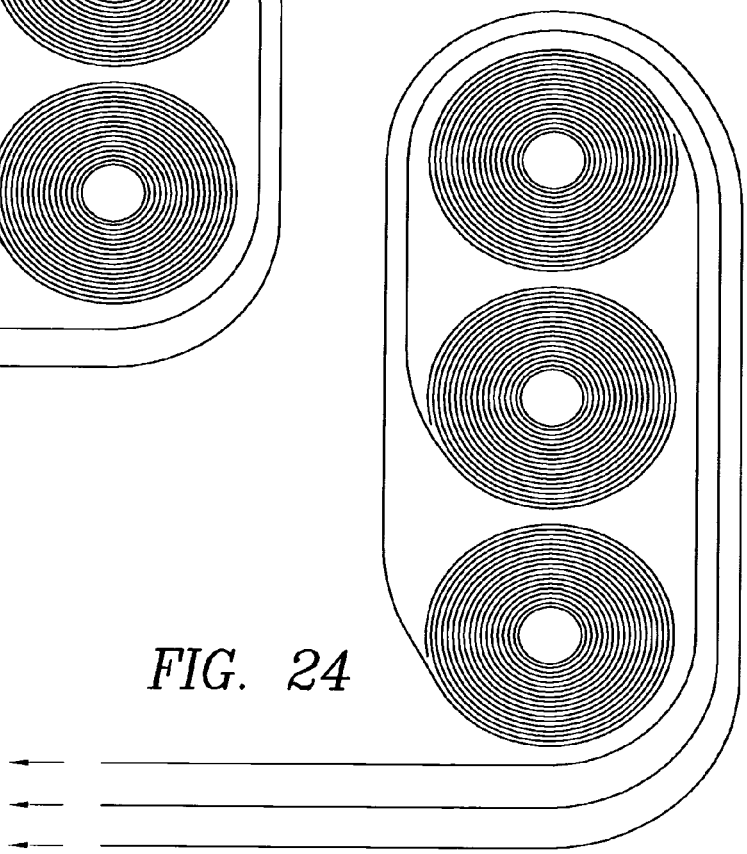
FIG. 24 is a schematic of three rolls of web material during dispensation from a triple axis dispenser.
Figure 25:
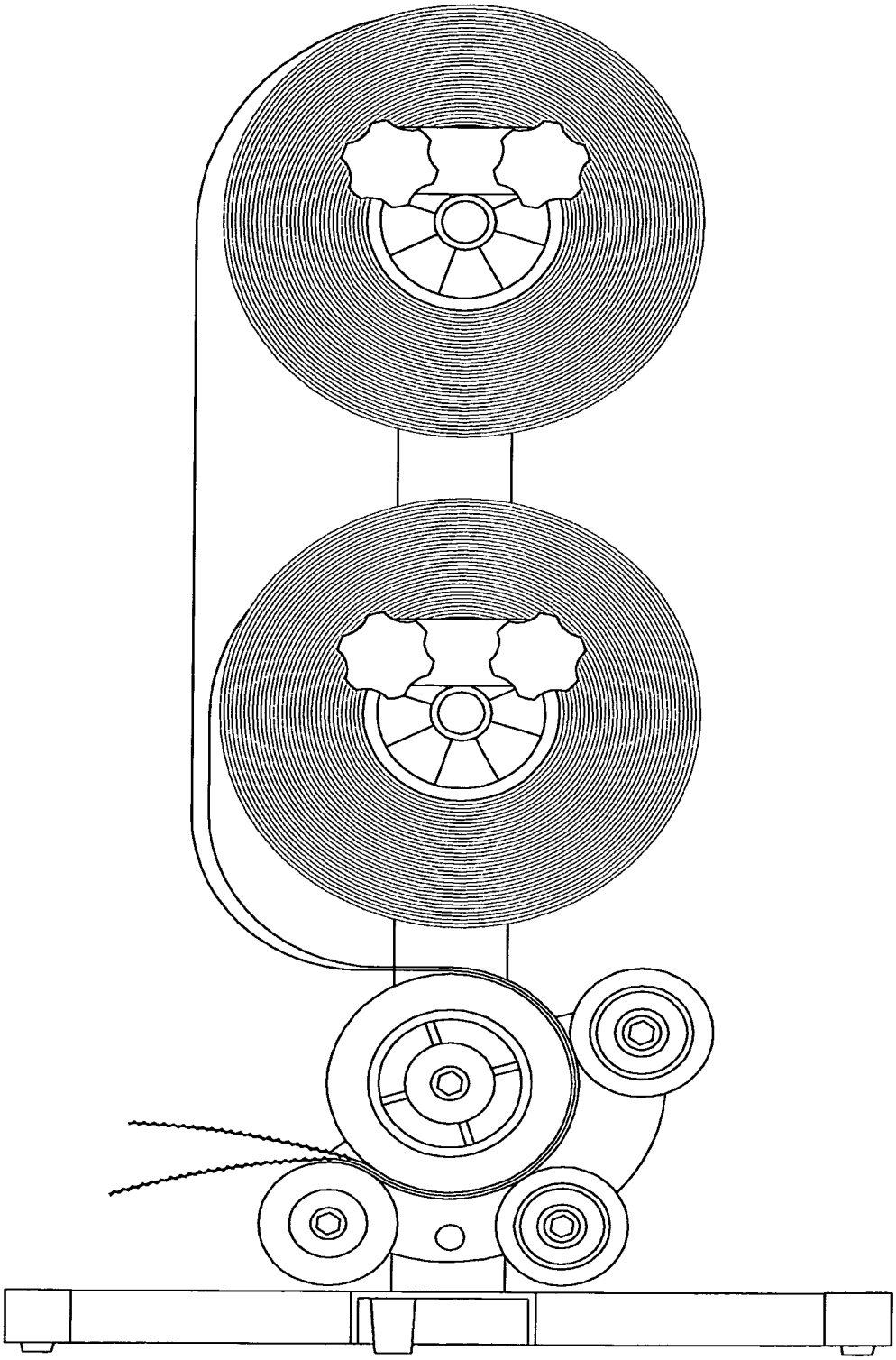
FIG. 25 is a side elevation of a double axle dispenser during dispensation of two rolls of web material.

FIG. 22 is a schematic of a single roll of web material during deployment from a single axle dispenser. FIG. 23 is a schematic of two rolls of web material during deployment from a double axle dispenser. FIG. 24 is a schematic of three rolls of web material during deployment from a triple axle dispenser. FIG. 25 shows how two rolls of web material would be deployed with a double axle dispenser. The unexpanded web material from both rolls is threaded through the guide wheel mechanism (comprising guide wheels 25 and 25*a*). The unexpanded web material from both rolls remains in contact until deployment is complete. As the unexpanded web sheets are pulled through the guide wheel mechanism, they each expand and separate as shown.

Figure 26:
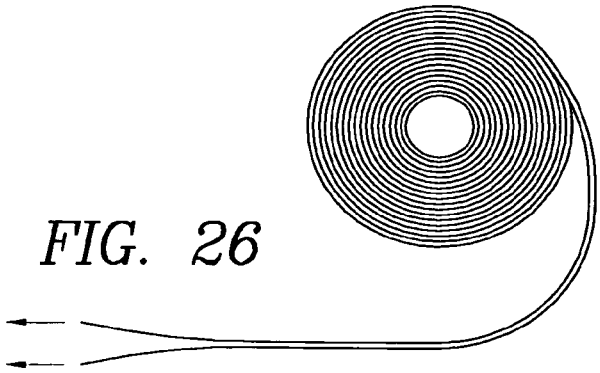
FIG. 26 is a schematic of a single roll of double layer web material during dispensation from a single axle dispenser.
Figure 27:
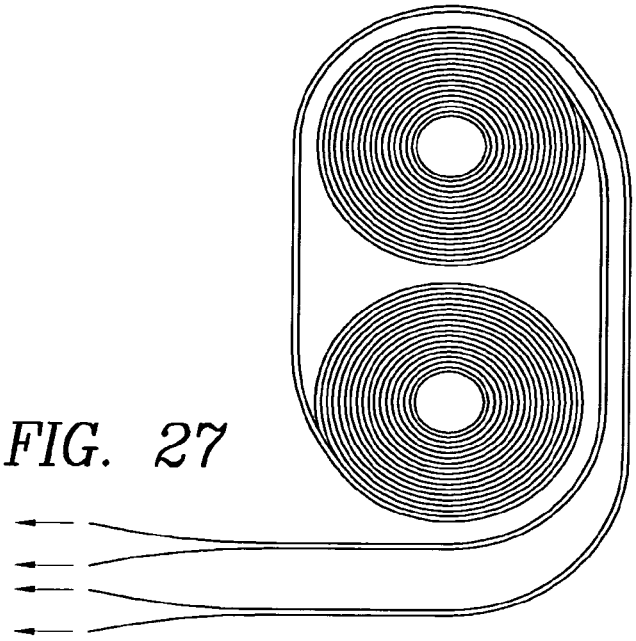
FIG. 27 is a schematic of two rolls of double layer web material during dispensation from a double axle dispenser.
Figure 28:
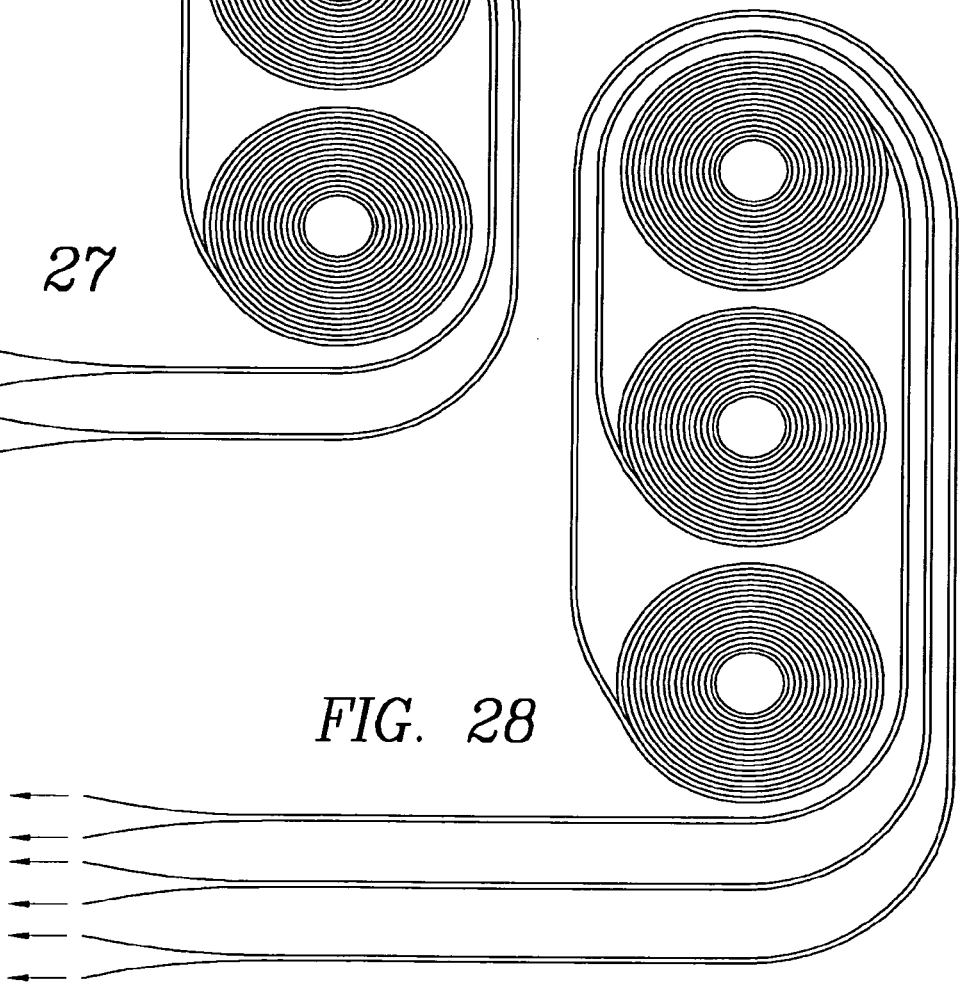
FIG. 28 is a schematic of three rolls of double layer web material during dispensation from a triple axis dispenser.

Each roll of unexpanded web material may comprise a plurality of unexpanded web sheets wound together in a single roll. Rolls of web material having two web sheets are shown in FIGS. 26, 27, and 28. FIG. 26 is a schematic of a single roll comprising two unexpanded web sheets wound together being deployed in a single axle dispenser. FIG. 27 is a schematic showing two such webbing rolls being deployed from a double axle dispenser.

Figure 29:
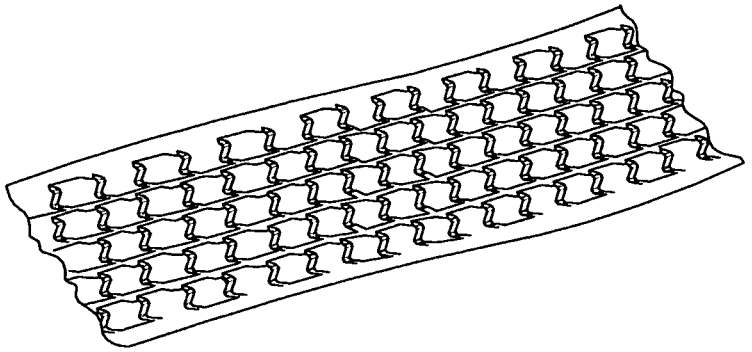
FIG. 29 is a plan schematic of expanded single layer web material.
Figure 30:
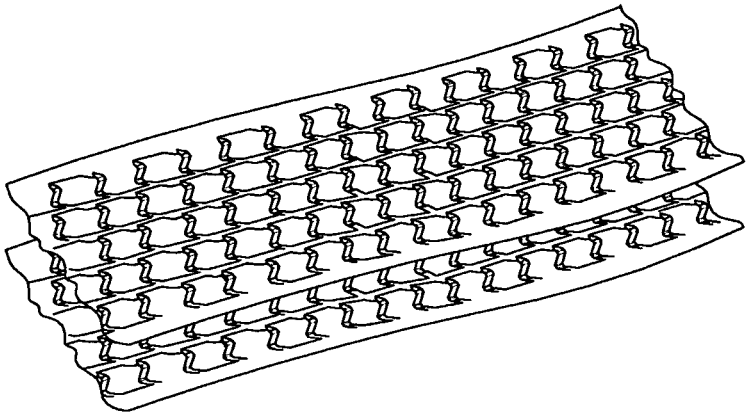
FIG. 30 is a plan schematic of expanded double layer web material.

FIG. 28 is a schematic showing three such webbing rolls being deployed from a triple axle dispenser. FIG. 29 shows the expanded web material that is deployed from a roll comprising a single web sheet. FIG. 30 shows the expanded web material that is deployed from a roll comprising two web sheets.

Figure 31:
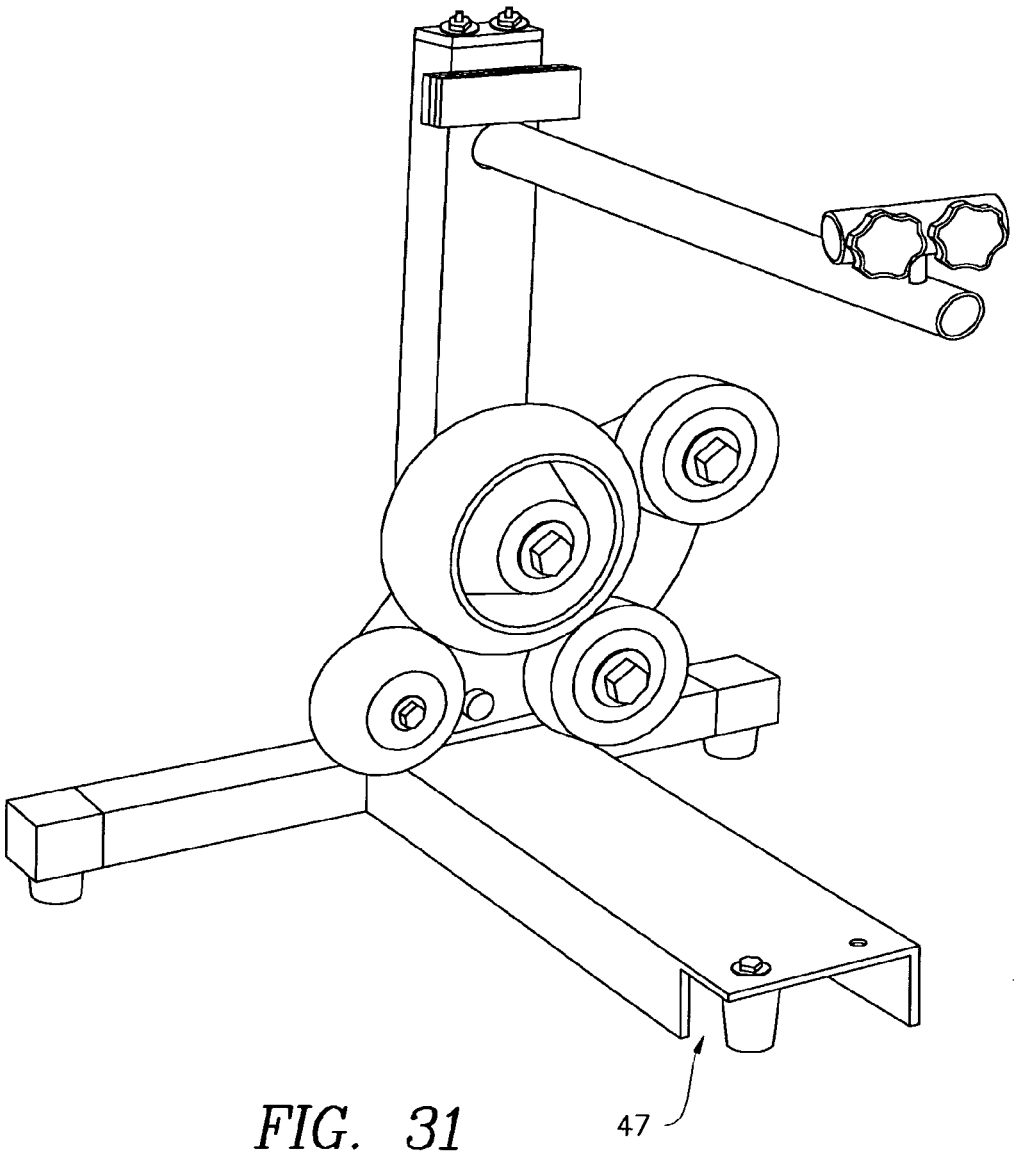
FIG. 31 is an isometric view of an alternate embodiment of the single axis dispenser with a notched base.
Figure 32:
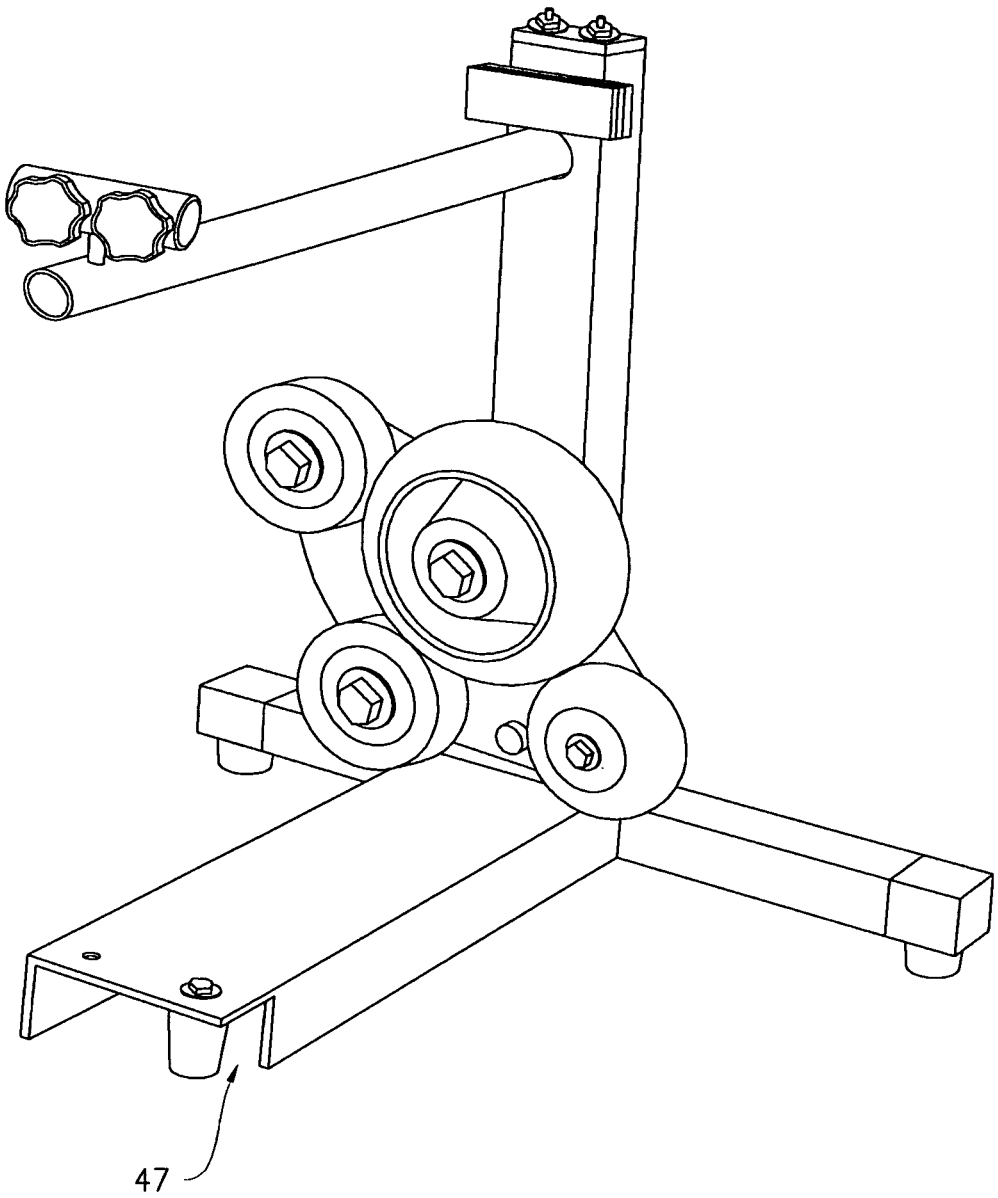
FIG. 32 is an isometric view of a reversed orientation of the embodiment shown in FIG. 31.

FIGS. 31 and 32 show a third embodiment of a single axle dispenser with a notch 47 cut in the base 14 (on the side opposite the stabilizing crossbar 16) to accommodate insertion of a motorized assembly. FIG. 31 shows one isometric view of this embodiment, while FIG. 32 is a reversed isometric view. The unit may be built in either orientation.

Figure 33:
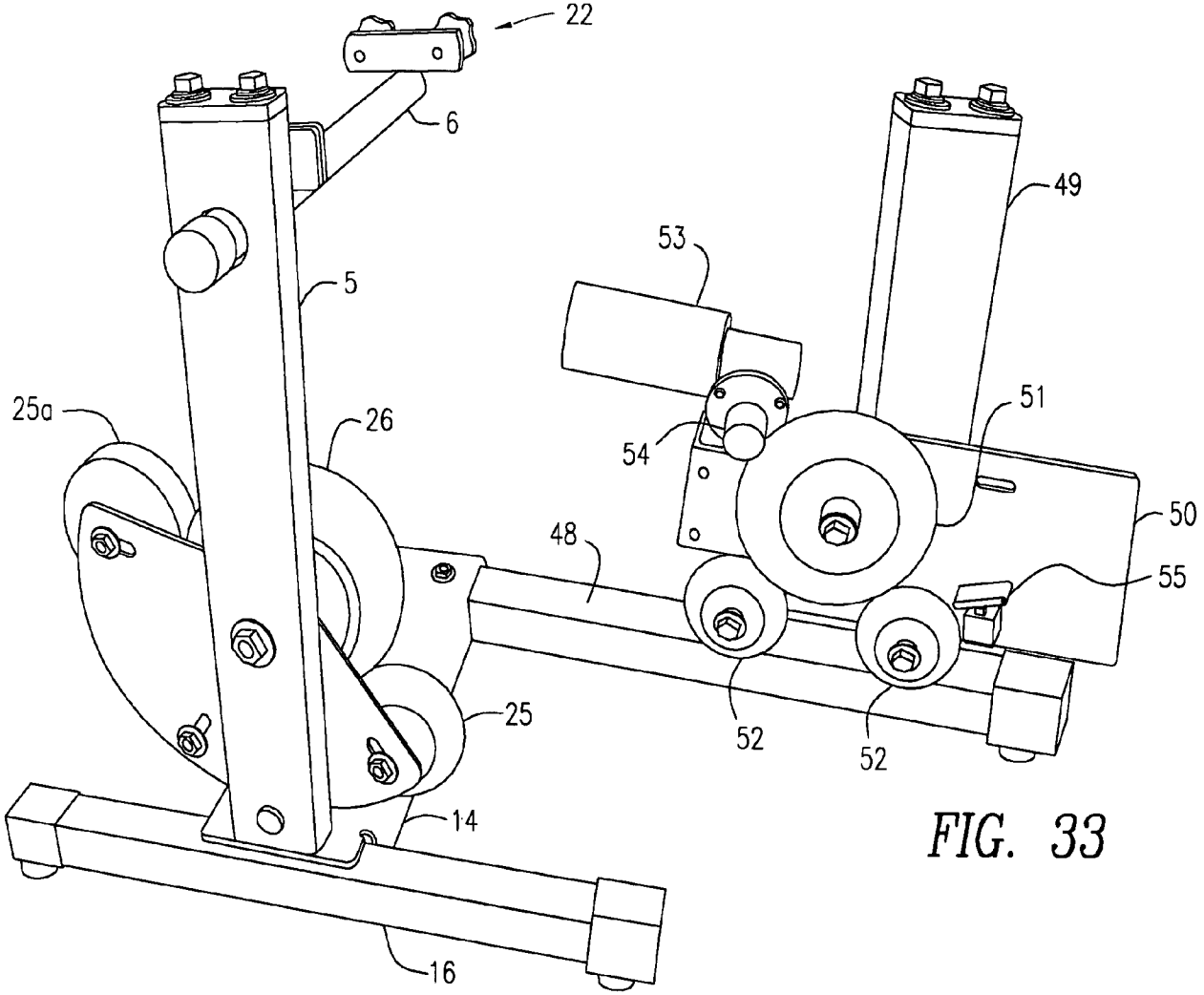
FIG. 33 is an isometric view of the single axle dispenser of FIG. 31 further comprising an electric component friction drive assembly.
Figure 34:
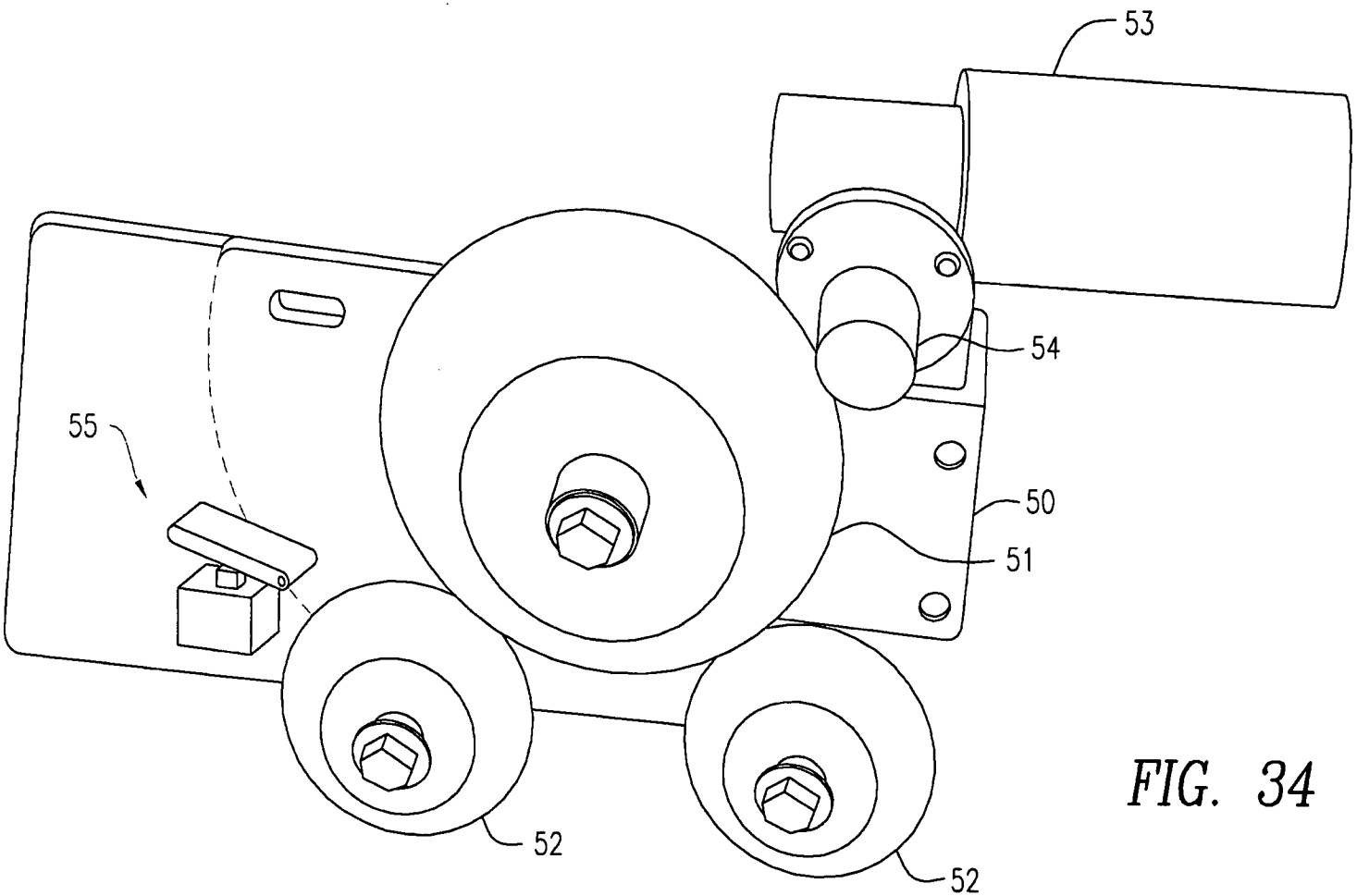
FIG. 34 is an isometric front side view of the electric component friction drive assembly of FIG. 33.
Figure 35:
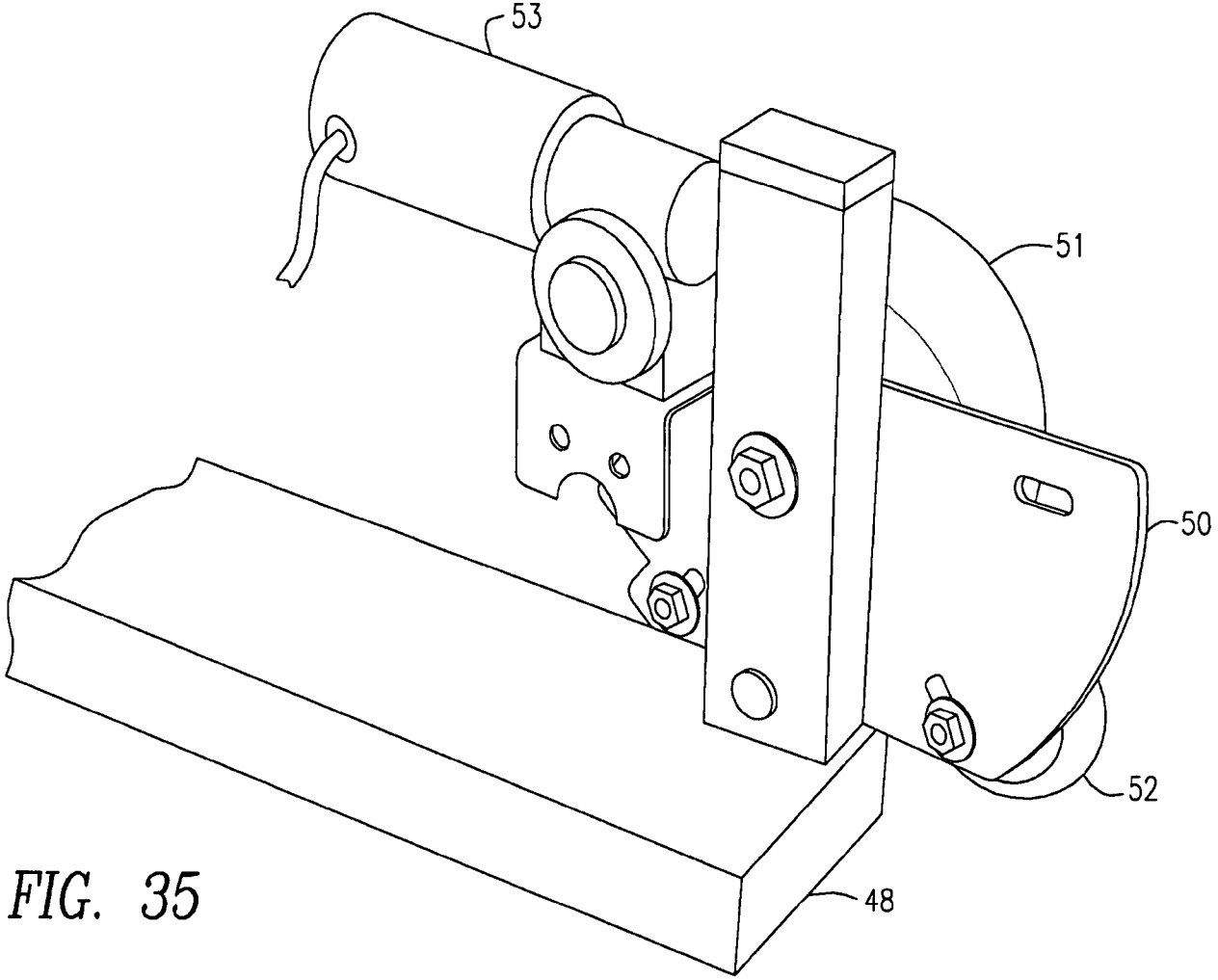
FIG. 35 is an isometric rear side view of the electric component friction drive assembly of FIG. 33.
Figure 36:
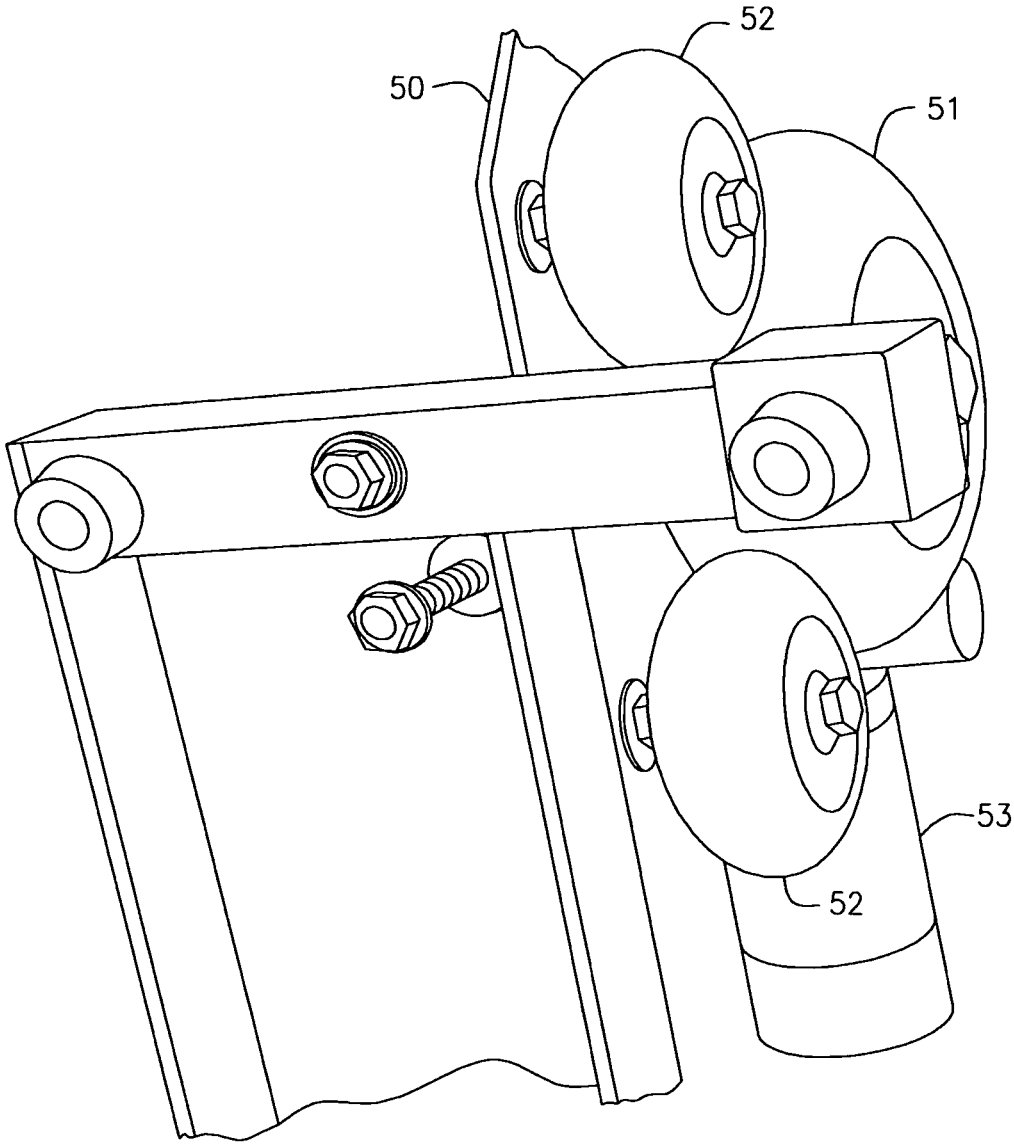
FIG. 36 is an isometric bottom view of the electric component friction drive assembly of FIG. 33.

FIG. 33 is the first embodiment of the motorized dispenser. The stabilizing crossbar 48 of the motor assembly is inserted into notch 47 of base 14. The motor assembly comprises stabilizing crossbar 48, a support tube 49 for the motor assembly, a mounting plate 50 for the motor assembly, a main drive wheel 51, idler tracking wheels 52, motor 53, pinch roller 54, and switch 55. The web material itself comprises two strands running longitudinally on either side of the web. The unexpanded web material is threaded through both the guide wheel assembly and the motor assembly rollers. An exemplary configuration of the guide wheel assembly comprising guide wheels 51 and 52 would be as the mirror image of the guide wheel assembly comprising guide wheels 25 and 25*a*. In this way, wheels 51 and 52 grab the longitudinal strand, and the entire unexpanded web material is held in place in the transverse direction. However, the longitudinal positions of guide wheels 51 and 52 must be ahead of guide wheels 25 and 25*a* so that diagonal tension can simultaneously deploy and expand the web material. Motor 53 causes pinch roller 54 to rotate, which in turn causes rotation of wheels 51 and 52. This motion pulls the unexpanded web material and causes it to deploy. Tension between these wheels and the guide wheels 25 and 25*a* causes the web material to expand during deployment. FIG. 34 is an isometric view showing greater detail of the front of the electric component friction drive assembly. FIG. 35 is an isometric view showing greater detail of the rear of the electric component friction drive assembly. FIG. 36 is an isometric bottom view of the electric component friction drive assembly.

Figure 37:
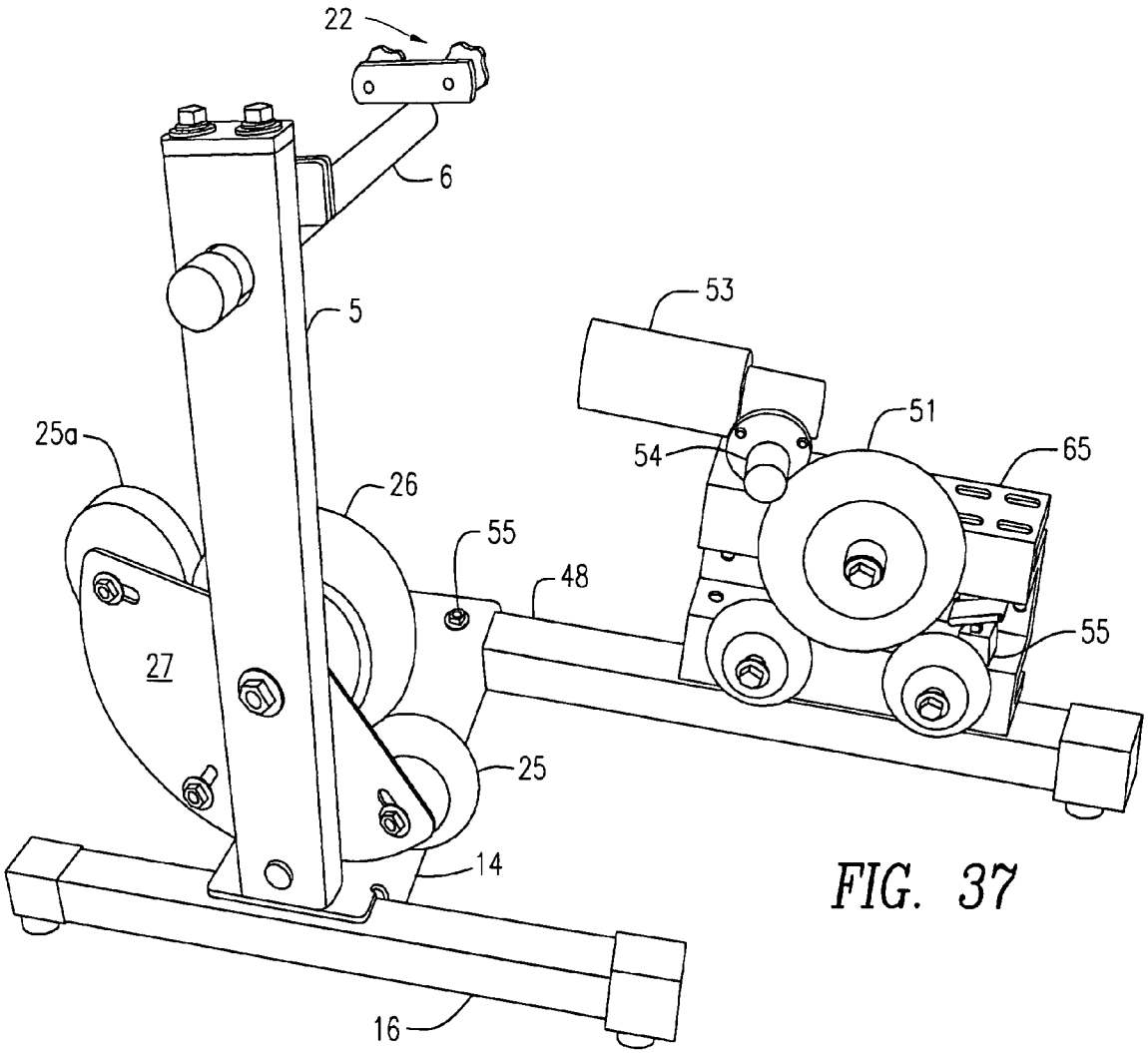
FIG. 37 is an isometric view of an alternate embodiment of the electric component friction drive assembly.
Figure 38:
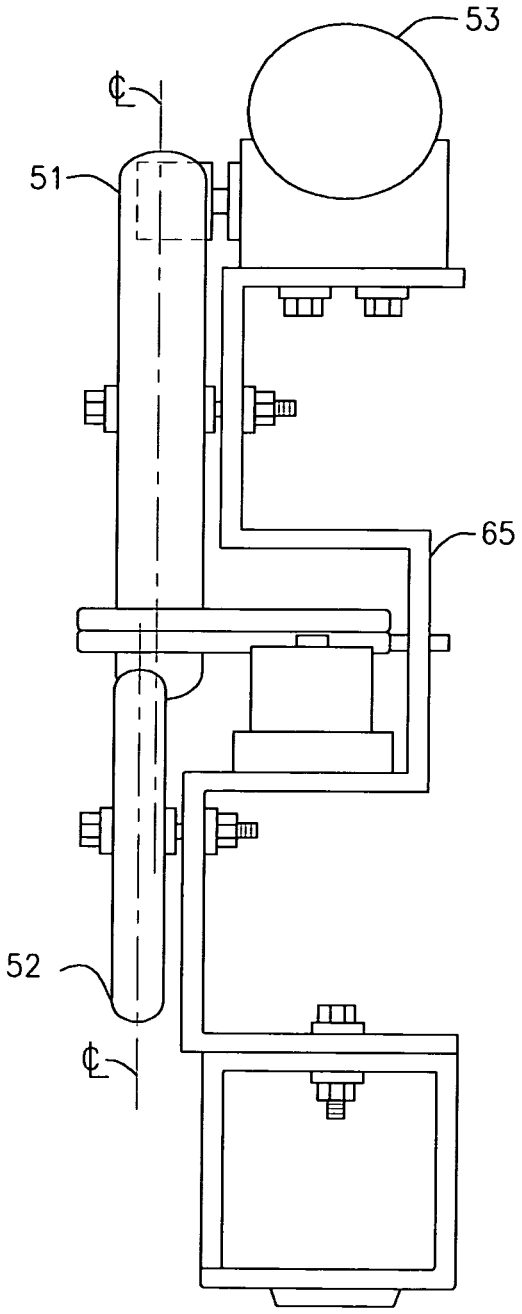
FIG. 38 is a front elevation of the alternate embodiment of the electric component friction drive assembly.
Figure 39:
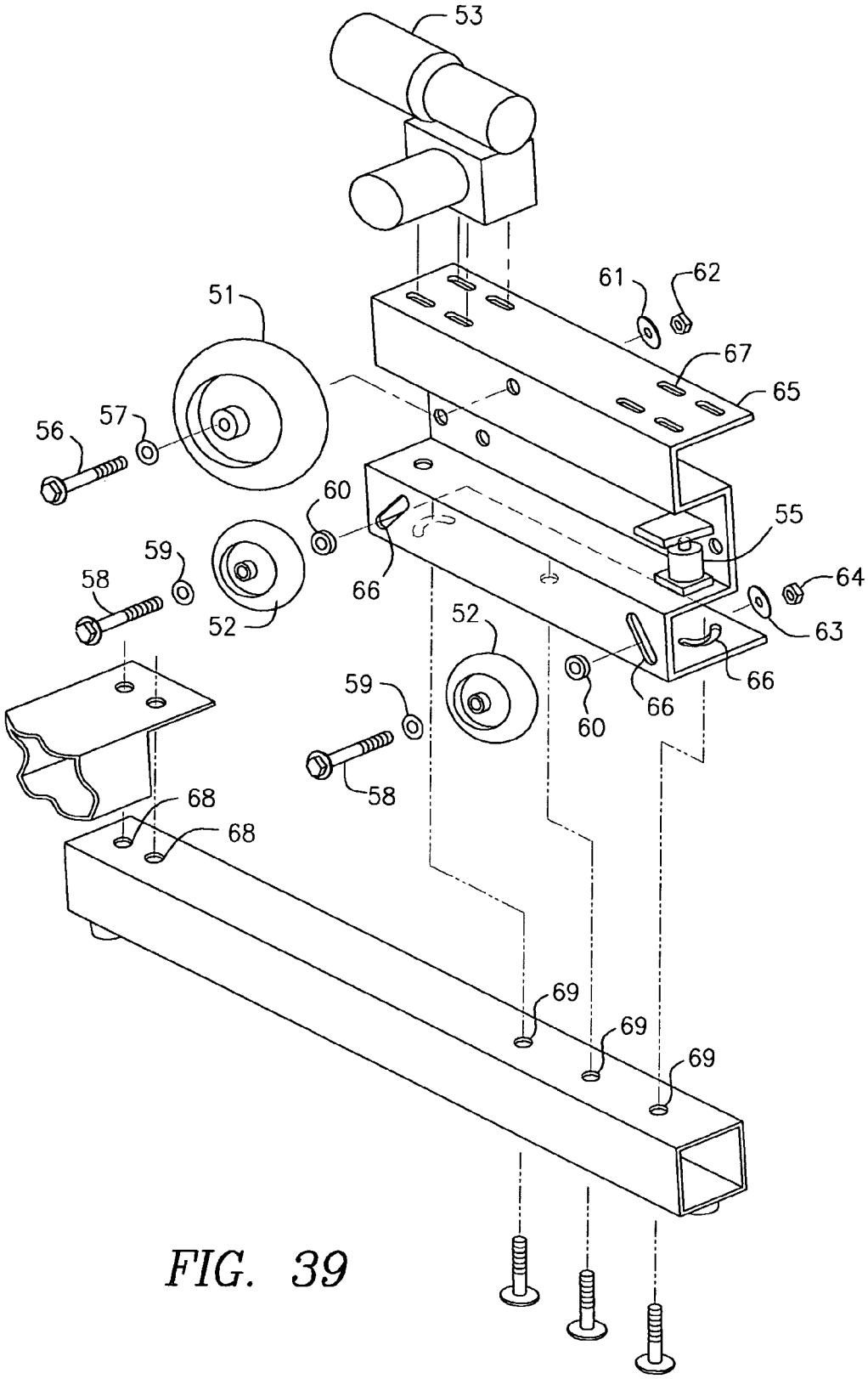
FIG. 39 is an isometric exploded view of the alternate embodiment of the electric component friction drive assembly.

FIGS. 37, 38, and 39 show an alternate embodiment of the electric component friction drive assembly. FIG. 37 is an isometric view of this embodiment. FIG. 38 is a front elevation of this embodiment. FIG. 39 is an isometric exploded view of this embodiment. The main difference between the two electric component friction drive assembly embodiments is that in this alternate embodiment, a specially designed plate 65 is used to mount the components, and the support tube 49 is unnecessary. The cross section of plate 65 is essentially a square wave. The plate comprises adjustment slots 66 for aligning the motor assembly mounting plate and adjustment slots 67 for the motor. The main drive wheel 51 is mounted to the top section of the plate using bolt 56, washers 57 and 61, and nut 62. The idler tracking wheels 52 are fed through alignment slots 66, and are held in place using bolts 58, washers 60 and 63, and nuts 64. The assembly is mounted to the stabilizing crossbar 48 through boltholes 68 and pivot holes 69.

Figure 40:
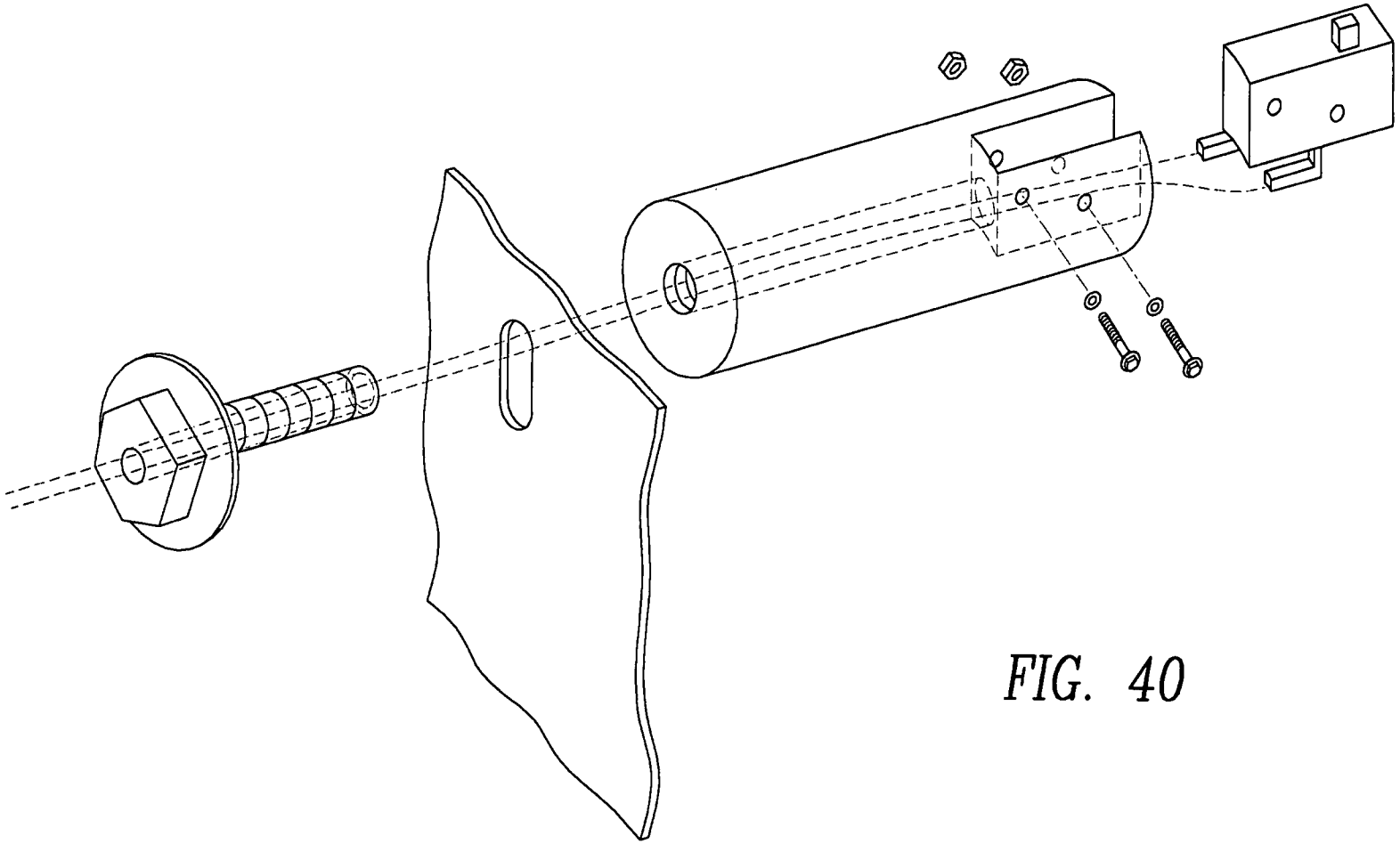
FIG. 40 is an isometric exploded view of the switch mounting.

FIG. 40 is an isometric exploded view showing mounting of the switch 55. Note that the bolt shown is hollow to allow electric wires to be threaded through the cylindrical axis of the bolt.

Figure 41:
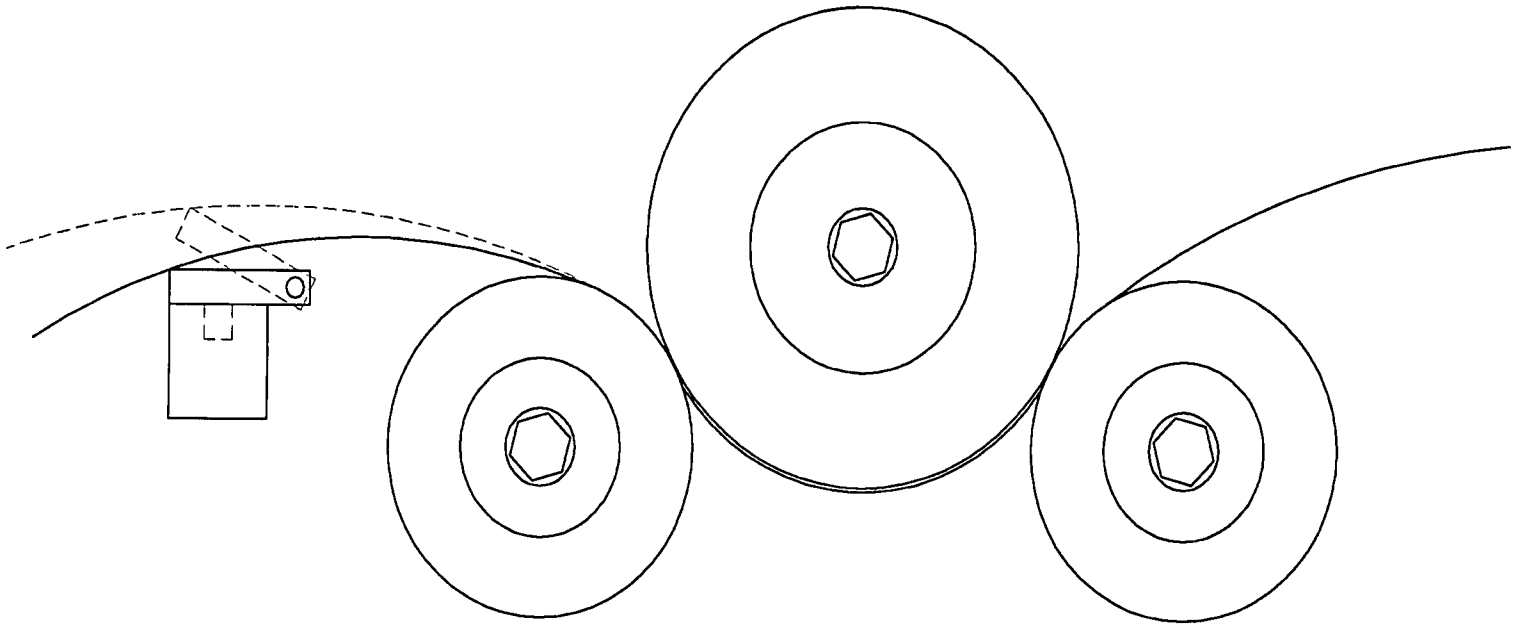
FIG. 41 is a schematic of single layer web material feed through the electric component friction drive assembly.
Figure 42:
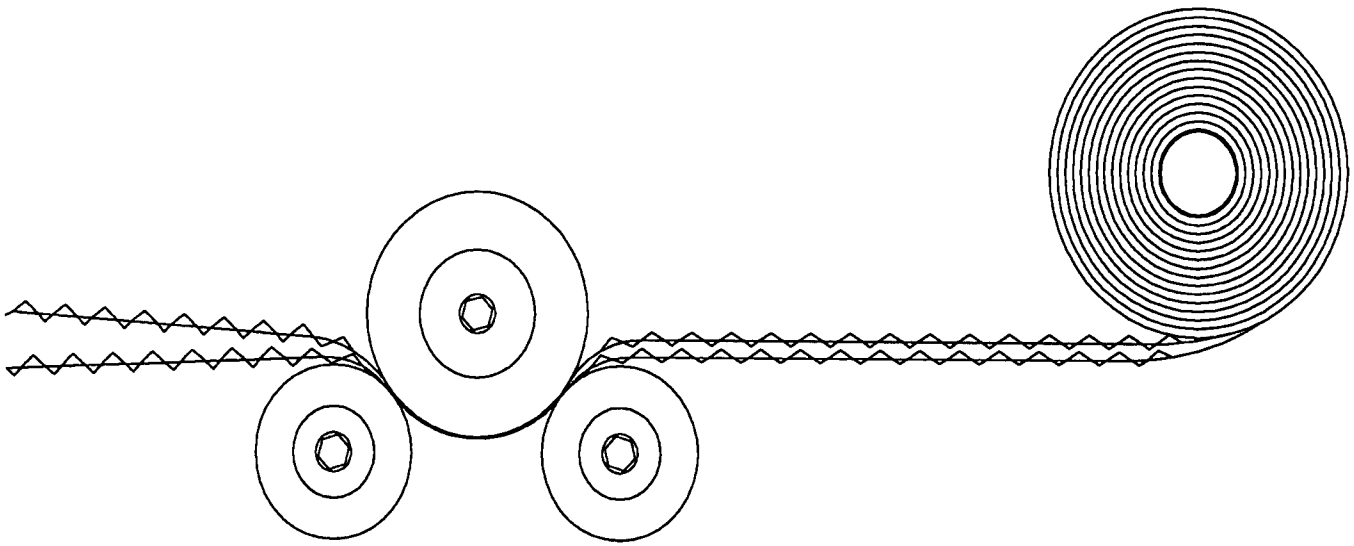
FIG. 42 is a schematic of double layer web material feed through the electric component friction drive assembly.

FIG. 41 is a schematic of single layer web material being deployed through the electric component friction drive assembly. FIG. 42 is a schematic of double layer web material being deployed through the electric component friction drive assembly.

We claim:

1. A dispenser to deploy and expand unexpanded web material from a spiral wound roll of said web material, wherein:

the unexpanded web material is flexible;

the unexpanded web material is substantially longer than it is wide;

the unexpanded web material is die cut so that it produces a three-dimensional lattice when expanded;

the unexpanded web material comprises an uncut longitudinal strand positioned along a transverse edge of the web material and running along the entire length of the web material;

the roll comprises a hollow cylindrical core around which the unexpanded web material is wound, said core having two opposite ends each at a transverse edge of the unexpanded web material; and the roll further comprises two annular shaped core plugs that are inserted at the two opposite ends of the hollow cylindrical core;

said dispenser comprising:

a) a base;

b) a support column affixed to and perpendicular to the base;

c) an axle for mounting the roll of unexpanded web material, wherein the axle is affixed to and perpendicular to the support column at a distance from the base;

d) a guide wheel assembly through which the unexpanded web material is threaded, wherein the guide wheel assembly is affixed to the base and the support column, and wherein the guide wheel assembly further comprises at least three guide rollers that contact and hold the unexpanded web material at the at the uncut longitudinal strand in at least three places; and e) a braking assembly to retard unraveling of the unexpanded web material from the roll, wherein the braking assembly further comprises:

i) a first component mounted to the support column and designed to contact with the core plug inserted in a first end of the mounted cylindrical core of the roll of unexpanded web material, said first component additionally comprising a plurality of elements, said plurality of elements being elastic and which serve to retard motion of the mounted roll of unexpanded web material at the first end of the mounted cylindrical core; and ii) a second component mounted to the axle, said second component additionally comprising a plurality of elements, wherein at least one of said plurality of elements is in contact with the core plug inserted in a second end of the mounted cylindrical core opposite said first end, and is adjustable to apply braking pressure to said core plug inserted in the second end of the mounted cylindrical core;

wherein the adjustable force applied to the core plugs at opposite ends of the mounted cylindrical core serves to retard motion of the roll as the web material unravels; and whereby, as the unexpanded web material is pulled through the guide wheel assembly by applying a diagonally transverse force, the unexpanded web material expands in both the longitudinal and transverse directions.

2. The dispenser of claim 1 wherein at least one of the at least three guide wheels of the guide wheel assembly is of toroidal shape.

3. The dispenser of claim 2 wherein at least one of the at least three guide wheels of the guide wheel assembly is a hollow cylinder having an annular cross-section.

4. The dispenser of claim 3 wherein the number of guide wheels comprised in the guide wheel assembly is three.

5. The dispenser of claim 4 wherein one of the guide wheels is of toroidal shape, and the other two guide wheels are hollow cylinders having an annular cross-section.

6. The dispenser of claim 5 wherein:

the plane of rotation of the toroidal shaped guide wheel is different from the plane of rotation of the cylindrical guide wheels;

both cylindrical shaped guide wheels rotate in the same plane; and the planes of rotation of the toroidal shaped guide wheel and cylindrical shaped guide wheels are both parallel to each other and perpendicular to the axle.

7. The dispenser of claim 1 wherein the plurality of elements of the first component of the braking assembly comprises:

a) a rigid backup plate;

b) an elastic plate, the resilience of which increases as more pressure is applied; and c) a break pad or wear plate which makes contact with the web core plug at the first end of the mounted cylindrical core.

8. The dispenser of claim 7 wherein the rigid backup plate is fabricated from metal.

9. The dispenser of claim 7 wherein the elastic plate is fabricated from rubber.

10. The dispenser of claim 7 wherein the break pad or wear plate is fabricated from plastic.

11. The dispenser of claim 1 wherein the plurality of elements of the second component of the braking assembly comprises:

a) a cylinder;

c) a mounting pin extending perpendicular to the cylindrical edge of the cylinder to enable mounting of the second component of the braking assembly in a hole on the axle;

d) at least one hole having machine screw threading; and e) at least one bolt screwed into the at least one threaded hole wherein the end of the at least one bolt makes contact with the core plug inserted into the second end of the mounted cylindrical core and applies a desired force to said core plug.

12. The dispenser of claim 11 wherein the cylinder of the second component of the braking assembly comprises two threaded holes into which two bolts are screwed.

13. The dispenser of claim 12 wherein the bolts further comprise mechanical devices at one end of each bolt to facilitate screwing the bolts into the threaded holes in order to achieve a desired force on the core plug.

14. The dispenser of claim 1 further comprising a stabilizing crossbar fastened to the base and support column.

15. The dispenser of claim 1 wherein the axle is securely affixed to the support column using a U-bolt fastened to the top of the support column.

16. The dispenser of claim 1 wherein the support column is securely affixed to the base and stabilizing crossbar using a U-bolt.

17. The dispenser of claim 1 wherein the axle is securely affixed to the support column using a U-bolt fastened to the side of the support column.

18. The dispenser of claim 1 wherein the axle is securely affixed to the support column using a bolt that is screwed into a nut located within the axle and accessible to the screw via holes drilled into both the support column and the axle.

19. The dispenser of claim 1 further comprising a plurality of axles for mounting rolls of unexpanded web material mounted to the support column, and a plurality of brake assemblies of number equal to the number of the plurality of axles, wherein each brake assembly comprises the first component which is secured to the support column and the second component which is secured to the respective axle.

20. The dispenser of claim 19 wherein the number of the plurality of axles is 2 or 3.

21. The dispenser of claim 19 wherein the rolls of unexpanded web material comprise a plurality of layers of unexpanded web material spiral wound together around a single cylindrical core.

22. The dispenser of claim 21 wherein the number of the plurality of layers of unexpanded web material is 2.

23. The dispenser of claim 1 wherein the unexpanded web material comprises two uncut essentially parallel longitudinal strands that run along the length of the web material and are positioned at opposite transverse ends of the web material.

24. The dispenser of claim 23 further comprising a notch cut into the base at a position opposite the guide wheel assembly in order to accommodate insertion of an electric component friction drive assembly.

25. The dispenser of claim 24 further comprising the electric component friction drive assembly, which additionally comprises:

a) a stabilizing crossbar inserted into the notch in the base, wherein said crossbar is inserted into the base in a direction perpendicular to the axle;

b) a second guide wheel assembly comprising at least three guide wheels for deploying the unexpanded web material, wherein said second guide wheel assembly is positioned to pull the unexpanded web material through the guide wheel assembly attached to the support column such that the guide wheel assembly attached to the support column grips one of the two essentially parallel uncut longitudinal strands, and the second guide wheel assembly grips the second of the two essentially parallel uncut longitudinal strands;

c) an electric motor;

d) a pinch wheel that is turned by the electric motor wherein said wheel causes the guide wheels of the second guide wheel assembly to rotate;

e) a switch to turn the electric motor on and off; and f) a mounting plate affixed to the stabilizing crossbar to which the second guide wheel assembly, the electric motor, the pinch wheel, and the switch are attached.

26. The dispenser of claim 25 wherein the electric component friction drive assembly further comprises a vertical support attached to the stabilizing crossbar and to which the mounting plate is affixed.

27. The dispenser of claim 25 wherein the mounting plate is affixed directly to the stabilizing crossbar without a vertical support.

28. The dispenser of claim 27 wherein the cross-section of the mounting plate is a square wave.

* * * * *